US010240309B2

(12) United States Patent
Winter et al.

(10) Patent No.: US 10,240,309 B2
(45) **Date of Patent: *Mar. 26, 2019**

(54) ELASTOMERIC PLOW EDGE

(71) Applicant: Winter Equipment Company, Willoughby, OH (US)

(72) Inventors: Kent Winter, Willoughby, OH (US); William A. Sulesky, Medina, OH (US)

(73) Assignee: Winter Equipment Company, Willoughby, OH (US)

( * ) Notice: Subject to any disclaimer, the term of this patent is extended or adjusted under 35 U.S.C. 154(b) by 67 days.

This patent is subject to a terminal disclaimer.

(21) Appl. No.: 15/224,895

(22) Filed: Aug. 1, 2016

(65) Prior Publication Data

US 2017/0009416 A1 Jan. 12, 2017

Related U.S. Application Data

(63) Continuation of application No. 14/478,703, filed on Sep. 5, 2014, now Pat. No. 9,428,874, which is a continuation-in-part of application No. 13/464,030, filed on May 4, 2012, now Pat. No. 8,844,173, which is a continuation-in-part of application No. 12/724,464, filed on Mar. 16, 2010, now Pat. No. 8,191,287.

(51) Int. Cl.

| | |
|---|---|
| ***E02F 3/00*** | (2006.01) |
| ***E01H 5/06*** | (2006.01) |
| ***E02F 3/815*** | (2006.01) |

(52) U.S. Cl.

CPC ..... *E01H 5/061* (2013.01); *E02F 3/8152* (2013.01); *Y10T 29/49739* (2015.01)

(58) Field of Classification Search

CPC ..... E02F 3/8152; E02F 3/8157; E02F 9/285; E01H 5/061; E01H 5/062; E01H 5/066; E01H 5/06

USPC ..... 37/233, 266, 279, 270, 271, 231; 172/701.3, 719, 747, 811, 816

See application file for complete search history.

(56) References Cited

U.S. PATENT DOCUMENTS

| | | | |
|---|---|---|---|
| 2,061,585 | A | 11/1936 | Meyer |
| 3,465,456 | A | 9/1969 | Meyer |
| 3,477,149 | A | 11/1969 | Wagner |
| 4,050,170 | A | 9/1977 | Proehl |
| 4,250,760 | A | 2/1981 | Gurries |
| 4,346,528 | A | 8/1982 | Shwayder |
| 4,347,677 | A | 9/1982 | Küper |
| 4,450,635 | A | 5/1984 | Shwayder |
| 4,476,642 | A | 10/1984 | Hemphill |
| 4,590,694 | A | 5/1986 | Block |
| 4,607,781 | A | 8/1986 | Shwayder |

(Continued)

*Primary Examiner* — Robert E Pezzuto

(74) *Attorney, Agent, or Firm* — Fay Sharpe LLP

(57) ABSTRACT

A plow edge having improved durability and performance is provided which can comprise an elastomeric material, for example, a styrene elastomeric material. The present disclosure provides a plow blade edge system for mounting to a mold board of a plow comprising an adapter blade, at least two elastomeric blade segments wherein each segment is selectively reversible to present first and second edges; a clamp bar wherein the clamp bar is mounted to the adapter blade with the at least two elastomeric blade segments secured therebetween; and, each of the at least two elastomeric blade segments secured selectively in a first orientation or a second orientation.

20 Claims, 19 Drawing Sheets

(56) References Cited

U.S. PATENT DOCUMENTS

| | | | |
|---|---|---|---|
| 4,711,503 | A | 12/1987 | Berchem et al. |
| 4,756,102 | A | 7/1988 | Chapman |
| 4,833,801 | A | 5/1989 | Winter |
| 4,899,472 | A | 2/1990 | Winter |
| 5,081,774 | A | 1/1992 | Kuwano |
| 5,096,772 | A | 3/1992 | Snyder |
| 5,210,965 | A | 5/1993 | Funk, Sr. et al. |
| 5,375,350 | A | 12/1994 | Maybon |
| 5,471,770 | A | 12/1995 | Ferreira |
| 5,611,157 | A | 3/1997 | Ferreira |
| 5,636,458 | A | 6/1997 | Drake |
| 5,647,448 | A | 7/1997 | Skaggs |
| 5,724,755 | A | 3/1998 | Weagley |
| 5,743,033 | A | 4/1998 | Gegel |
| 5,946,830 | A | 9/1999 | Ostermeyer |
| 6,240,662 | B1 | 6/2001 | Borowiak |
| 6,256,910 | B1 | 7/2001 | Grozde |
| 6,269,559 | B1 | 8/2001 | Edwards |
| 6,315,056 | B1 | 11/2001 | Ransom et al. |
| 6,457,269 | B1 | 10/2002 | Esterhuyse et al. |
| 6,560,904 | B2 | 5/2003 | Guggino |
| 6,571,493 | B2 | 6/2003 | Amano et al. |
| 6,751,894 | B2 | 6/2004 | Verseef |
| 6,832,443 | B1 | 12/2004 | Piel et al. |
| 6,854,808 | B2 | 2/2005 | Kostecki |
| 6,922,924 | B2 | 8/2005 | Jones et al. |
| 7,143,531 | B2 | 12/2006 | Micozzi |
| 7,159,344 | B2 | 1/2007 | Karhi |
| 7,347,014 | B1 | 3/2008 | Fiandach |
| 7,665,234 | B2 | 2/2010 | Diehl et al. |
| 7,730,641 | B2 | 6/2010 | Ruuska |
| 7,874,085 | B1 | 1/2011 | Winter et al. |
| 8,222,893 | B2 | 7/2012 | Holfeld |
| 8,984,778 | B2 * | 3/2015 | Fox ..... E01H 5/062 37/266 |
| 9,290,898 | B2 * | 3/2016 | Abramczyk ..... E01H 5/062 |
| 2003/0182824 | A1 | 10/2003 | Coffin et al. |
| 2003/0221338 | A1 | 12/2003 | Verseef |
| 2004/0006898 | A1 | 1/2004 | Koch et al. |
| 2006/0218822 | A1 | 10/2006 | Hosmer |
| 2007/0062072 | A1 | 3/2007 | Schmeichel |
| 2007/0256334 | A1 | 11/2007 | Schmeichel |
| 2008/0263907 | A1 | 10/2008 | Winter |

* cited by examiner

ELASTOMERIC PLOW EDGE

The present invention is a continuation of U.S. patent application Ser. No. 14/478,703, filed Sep. 5, 2014, which in turn is a continuation-in-part of U.S. application Ser. No. 13/464,030, filed May 4, 2012, which in turn is a continuation-in-part of U.S. patent application Ser. No. 12/724,464, filed Mar. 16, 2010 which are incorporated herein by reference in their entirety.

BACKGROUND

The present disclosure relates generally to devices for improving the durability, performance, and operation of plow blades as well as, methods of mounting plow blades. Specifically, the present disclosure provides an improved plow blade edge, for example, snow plow edge and method for mounting and/or replacing.

Rough terrain and cold weather conditions have caused problems for snow plow blades for as long as there have been snow plows. Although many modifications and alternative designs have been made to snow plow blades in attempts to improve the life, durability, and performance of snow plow blades, in particular, the life, durability and performance of snow plow blade edges, most of these modifications and alterations did not provide sufficient durability and ride improving capabilities to deal with, among other things, the rough terrain and cold weather that snow plow blades are typically exposed to. Typically, prior art snow plow edges are metallic, for example, steel, and are excessively damaged or even destroyed due to wear from contact between the plow edge and the terrain and corrosion (which is exacerbated by road salt). Such prior art blade edges must frequently be repaired or replaced.

In addition, rigid prior art snow plow blade edges typically can damage the surface over which they are moved, for example, asphalt or concrete. Due to their rigidity, snow plow blade edges typically transmit loads, for example, shock loads to the vehicle, and vehicle mounting components to which the plow blade is attached. The aforementioned shock loads, in turn, are then transmitted to the driver of the vehicle. These loads can damage or incapacitate the vehicle or vehicle mounting components. In addition, the shock loads exacerbate a driver's dissatisfaction with the task of plowing. Furthermore, metallic prior art blade edges are not effective in plowing fluid-like or finely granulated media, for example, slush, water, and other fluids or powders. There is a need in the art to provide a snow plow blade edge which avoids these limitations of prior art plow blade edges, in particular, limitations in prior art snow plow blade edges.

The present disclosure describes a resilient construction material and method of mounting which can be used to provide new plow blade edges or replace worn plow blade edges, in particular, snow-plow blade edges or other surface plows, that overcome many of the limitations of the prior art.

SUMMARY

One aspect of the present disclosure provides for a plow blade edge system which can be mounted to a mold board of a plow. The plow blade system includes an adapter blade including a bottom edge having a carbide insert along a portion of the bottom edge. The blade system further includes an elastomeric blade selectively reversible to present first and second edges in a multitude of positions. Furthermore, the blade system includes a clamp bar wherein the clamp bar is mounted to the adapter blade with the elastomeric blade therebetween.

Another aspect of the present disclosure provides a method for replacing an existing plow edge with an elastomeric plow edge. The method comprises mounting at least one adapter blade to a mold board; attaching at least one planar elastomeric plow edge segment to the at least one adapter blade; and, connecting at least one clamp bar to the at least one adapter blade wherein the at least one planar elastomeric plow edge segment is secured between the at least one adapter blade and the at least one clamp bar in a first position.

Another aspect of the present disclosure provides for a plow blade edge kit for mounting to a mold board of a plow. The edge kit comprises an adapter blade including mounting holes for mounting to a mold board. The adapter blade further includes mounting bushings. The edge kit further provides for a rubber plow blade including holes for placing on the mounting bushings selectively in a first position or a second position, a clamp bar having holes aligned with the mounting bushings, and a plurality of fasteners passing through the mounting bushings for securing the clamp bar to the adapter bar whereby the rubber plow blade is mounted between the clamp bar and the adapter blade.

Still yet another aspect of the present disclosure provides for a plow blade edge system for mounting to a mold board of a plow comprising: an adapter blade including a bottom edge; an elastomeric blade selectively rotatable to present a first edge in a first orientation and a second edge in a second orientation to a plow surface; and, a clamp bar wherein the clamp bar is mounted to the mold board with the elastomeric blade and the adapter blade secured therebetween. The elastomeric blade is secured selectively in the first orientation or the second orientation. The elastomeric blade is reversed to present the second edge in the second orientation to a plow surface after the first edge in the first orientation is worn to a wear line. Each of the first and the second orientations centers the elastomeric blade about a mounting axis.

The present disclosure further provides for a method for replacing an existing plow edge with an elastomeric plow edge comprising: mounting at least one adapter blade to a mold board; positioning and attaching at least two planar elastomeric plow edge segments to the at least one adapter blade; and, connecting at least one clamp bar to said mold board with a plurality of fasteners wherein the at least two planar elastomeric plow edge segments is secured between the at least one adapter blade and the at least one clamp bar in a selected first orientation.

The present disclosure still further provides for a plow blade edge kit for mounting to a mold board of a plow comprising an adapter blade including mounting holes for mounting to a mold board. The adapter blade further includes mounting bushings. The plow edge kit further comprises an elastomeric plow blade including holes for placing on the mounting bushings wherein the elastomeric plow blade is selectively mounted in a first position or a second position. The plow edge kit further comprises a clamp bar having holes aligned with the mounting bushings. A plurality of fasteners passes through the holes of the clamp bar, the holes of the elastomeric plow blade, and the mounting bushings of the adapter blade for securing the plow edge kit to the mold board whereby the elastomeric plow blade is mounted between the clamp bar and the adapter blade.

BRIEF DESCRIPTION OF THE DRAWINGS

The subject matter which is regarded as the disclosure is particularly pointed out and distinctly claimed in the concluding portion of the specification. The present disclosure, however, both as to organization and method of practice, together with further objects and advantages thereof, may best be understood by reference to the following detailed descriptions of the preferred embodiments and the accompanying drawings in which:

DETAILED DESCRIPTION

Figure 1:
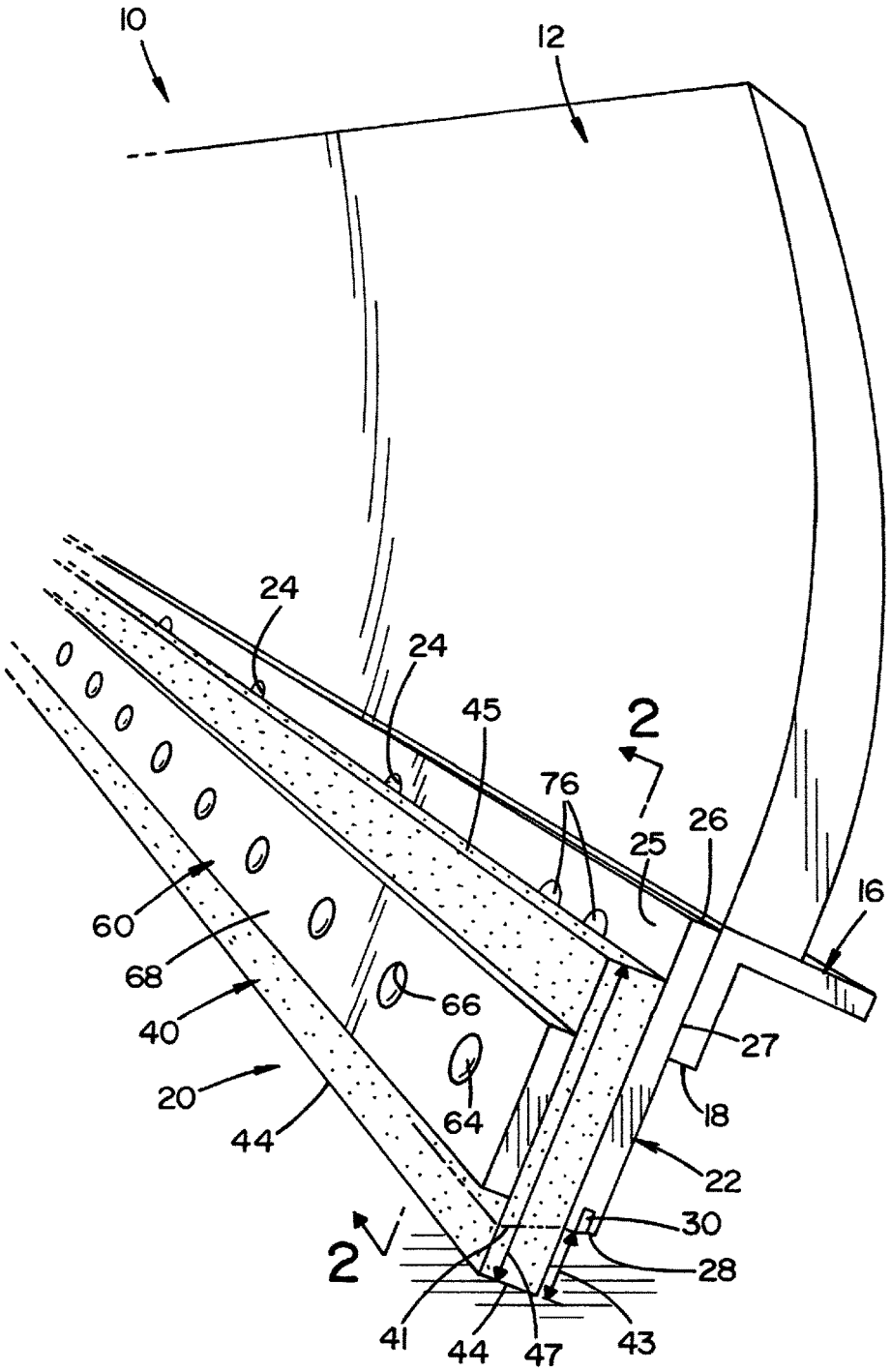
FIG. 1 is a perspective view of a plow blade according to one aspect of the present disclosure.

FIG. 1 is a perspective view of a plow assembly 10 displaying one aspect of the present disclosure. The plow assembly 10 includes a plow body 12 which is typically of hemispherical and funnel shaped steel construction for deflecting snow or other media. Plow assembly 10 is typically attached to a vehicle (not shown) by means of an appropriate frame or housing (also not shown). The vehicle may be any vehicle ranging from a standard car or pickup truck to a sand and salt-carrying dump truck to a road grader having a belly-mounted blade, to huge earth-moving or snow-moving plows. The means of attaching the plow body 12 to a vehicle may also typically include some form of hydraulic mechanism for positioning plow body 12 as desired, as is typical in the art. The plow assembly 10 may also include one or more reinforcing members to provide strength and rigidity to plow body 12. Reinforcing members are typically standard structural angles which are attached to the back of plow body 12, for example, by means of welding.

The plow assembly 10 can include at least one replaceable (or non-replaceable) plow body edge or mold board 16 mounted to the base of plow body 12 where edge 18 will contact the plowed surface, for example, a road surface. Mold board 16 is usually replaceable since its rigid construction is typically prone to damage due to abrasive contact with the surface being plowed or to obstacles, for example, pot holes, sewer covers, trees, mail boxes, and the like, encountered while plowing. Mold board 16 is typically of metallic construction, for example, steel construction, and is mounted to body 12 by a plurality of mechanical fasteners, for example, a plurality of nuts, bolts; and washers (not shown). Mold board 16 typically includes slotted perforations to allow for adjustment of the mounting of the mold board 16 during initial installation or for adjustment of the mounting of the mold board 16 after use and wear.

Figure 2:
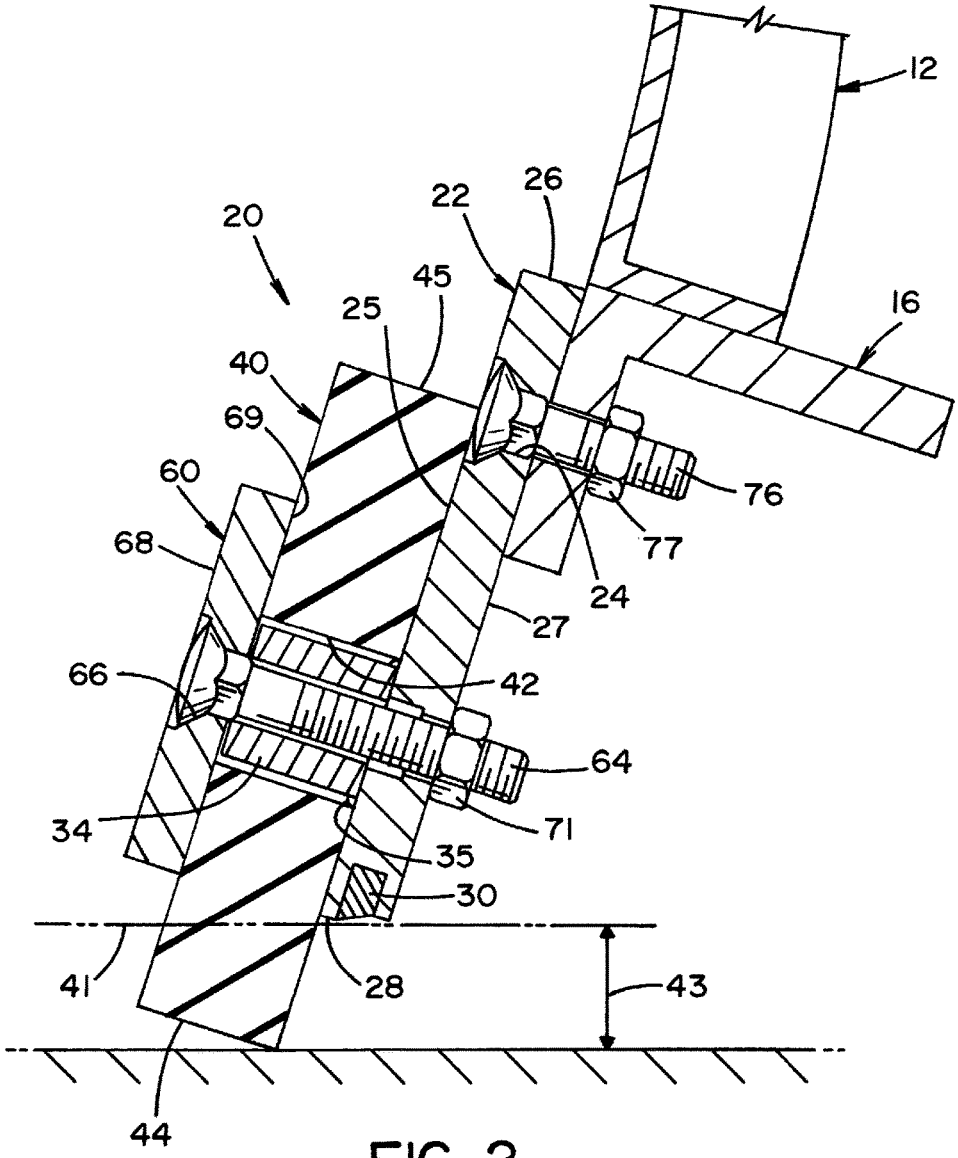
FIG. 2 is a cross sectional view taken along section lines 2-2 in FIG. 1 according to a first mounting arrangement.
Figure 3:
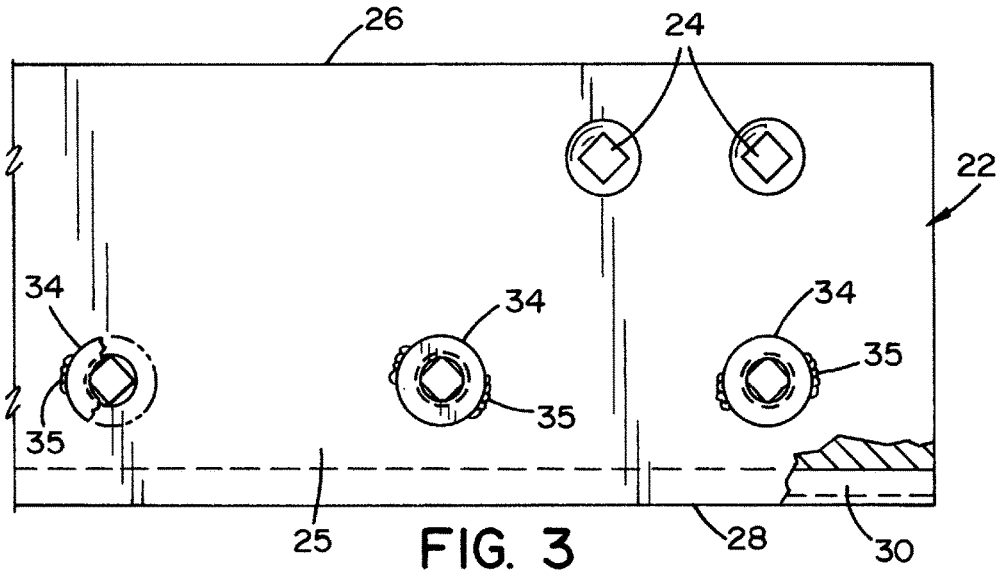
FIG. 3 is a plan view of an adapter blade.

Referring now to FIGS. 1-5, a plow blade edge system 20 is therein displayed. Namely, an adapter blade 22 can be mounted to the mold board 16 of the plow body 12. The mold board 16 can be in a damaged or used condition. FIG. 3 illustrates a detailed plan view of adapter blade 22 according to one aspect of the present disclosure. The adapter blade 22 includes mounting holes 24 aligned along a top edge 26 for securing to the mold board 16. The adapter blade 22 can be from about ¼ inch thick to about 1¼ inch thick and can be made from steel or similar materials. A bottom edge 28 along the adapter blade 22 can include high grade imbedded carbide inserts 30 along at least a portion thereof. To be described in more detail hereinafter, as a rubber blade 40 wears, or is damaged, the adapter blade 22, specifically the carbide inserts 30 along the bottom edge 28, act as a backup to resist wear until the rubber blade 40 can be flipped or replaced. It is to be appreciated that the adapter blade 22 can turn a damaged mold board 16 into a solid mounting surface for the rubber blade 40 or to protect a new mold board 16. In addition, the adapter blade 22 includes a series of bushings 34 aligned proximal to the bottom edge 28. The bushings 34 can be welded 35 to the front face 25 of the adapter blade 22. The bushings 34 provide a mounting arrangement for the rubber or elastomeric plow blade or edge segments 40. The bushings 34 provide a stable mounting platform that holds the plow edge segment 40 in a fixed position for ease of attachment between the adapter blade 22 and a clamp bar 60.

The dimensions of adapter blade 22 will vary depending upon the size of plow body 12 used, for example, the length of blade 22 is limitless, but reinforcing blade 22 typically will have a length from about 3 to about 12 feet. The width or height of blade 22 can be between about 3.0 to about 12.0 inches. For some exemplary embodiments, the length of individual segments of the adapter blade 22 can be 3, 4, 5, and/or 6 feet. In this manner, any combination of two, or three, blade segments can be combined to extend across plow blade 12 having a length of 6, 7, 8, 9, 10, 11 or 12 feet.

Figure 4:
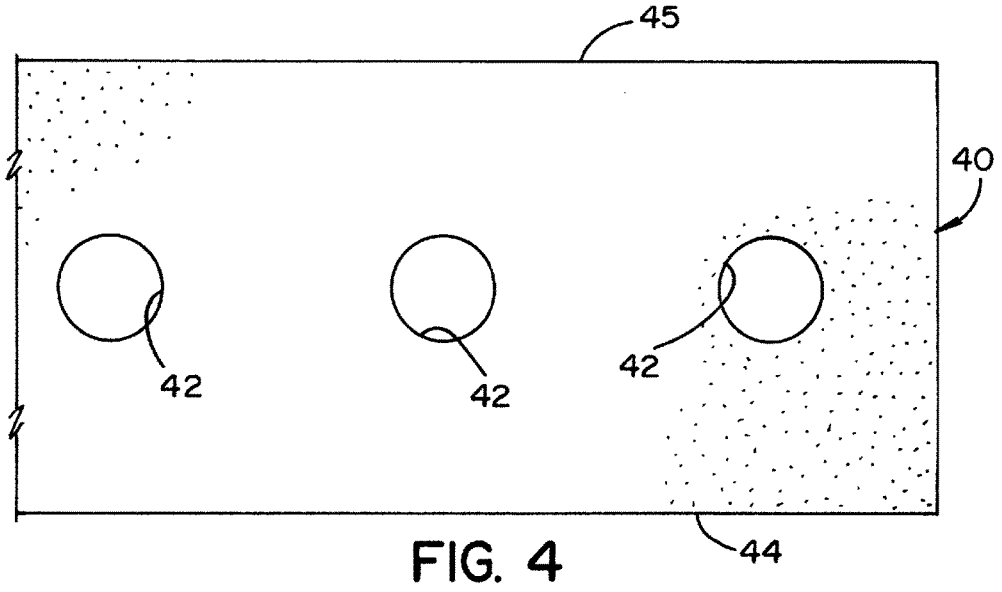
FIG. 4 is a plan view of an elastomeric blade.
Figure 5:
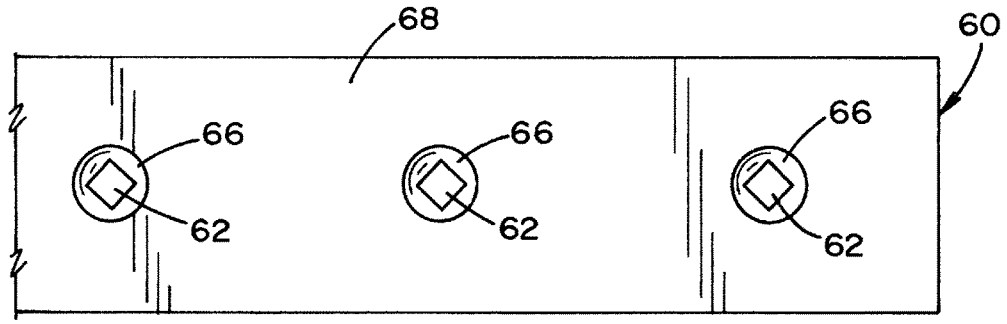
FIG. 5 is a plan view of a clamp bar.

Referring now to FIG. 2, there is shown, plow edge segments mounted to the adapter blade 22, a planar elastomeric plow blade member 40 (FIG. 4). The elastomeric plow edge segment(s) 40 can comprise styrene butadiene rubber (SBR), polyurethane, polyethylene, polystyrene, and rubber. The elastomeric plow edge segment 40 can be pre-drilled including apertures 42 aligned with the bushings 34 of the adapter blade 22. The elastomeric plow edge segment 40 includes two mounting positions such that when first installed in a first position, a first edge 44 is presented to the road surface below. After the first edge 44 has worn to wear line 41, the elastomeric plow edge segment 40 can be dismounted from the plow blade edge system 20, reversed, and remounted such that the elastomeric plow edge segment 40 now is in a second position which presents a second edge 45 to the road surface below. Although not shown, it is to be appreciated that the second edge 45 can wear to a second wear line. Each wear line can be up to about 25% of the overall width or height of edge segment 40. More particularly, the distance 43 from the initial edge 44 to wear line 41 can be about 25% of the overall initial width 47 of plow edge segment 40. In this manner, the overall wear of edge segment 40 can be up to about 50% of the initial width. In one embodiment, the overall wear (i.e. width reduction) of edge segment 40 is from about 28% to about 50% after both edges 44, 45 have worn to their respective wear lines. Thus, the elastomeric plow edge segment 40 enables an extended life for improved performance and a decrease in material cost.

It is to be appreciated, that the elastomeric plow edge segment 40 can comprise any variety of heights and a variety of lengths. The dimensions of elastomeric blade 40 will vary depending upon the size of plow body 12 used, for example, the length of plow edge segment 40 is limitless, but edge segment 40 typically will have a length from about 3 feet to about 12 feet. The width or height of blade 40 can be from about 4.0 inches to about 12.0 inches. The thickness of blade 40 can be from about 0.50 inches to about 3.0 inches. Exemplary embodiments include elastomeric plow blade segments 40 of 3, 4, 5, and 6 foot lengths. In this manner, any combination of two, or three, blade segments 40 can be combined to extend across mold board 16 of 6, 7, 8, 9, 10, 11, and 12 foot lengths. The aforementioned lengths of plow edge segments 40 provide ease of handling and ease of mounting to the adapter blade 22. The plow edge segments 40 can be easily handled and mounted by one person. The plow edge segments 40 can be planar or linear in orientation. In this manner the plow edge segments 40 retain a flat and planar orientation for ease of mounting. Elastomeric plow blade members heretofore known typically comprise segments cut off from a coiled storage means. A coiled configuration presents difficulties in trying to straighten and mount a curled or curved elastomeric plow blade segment.

Figure 6:
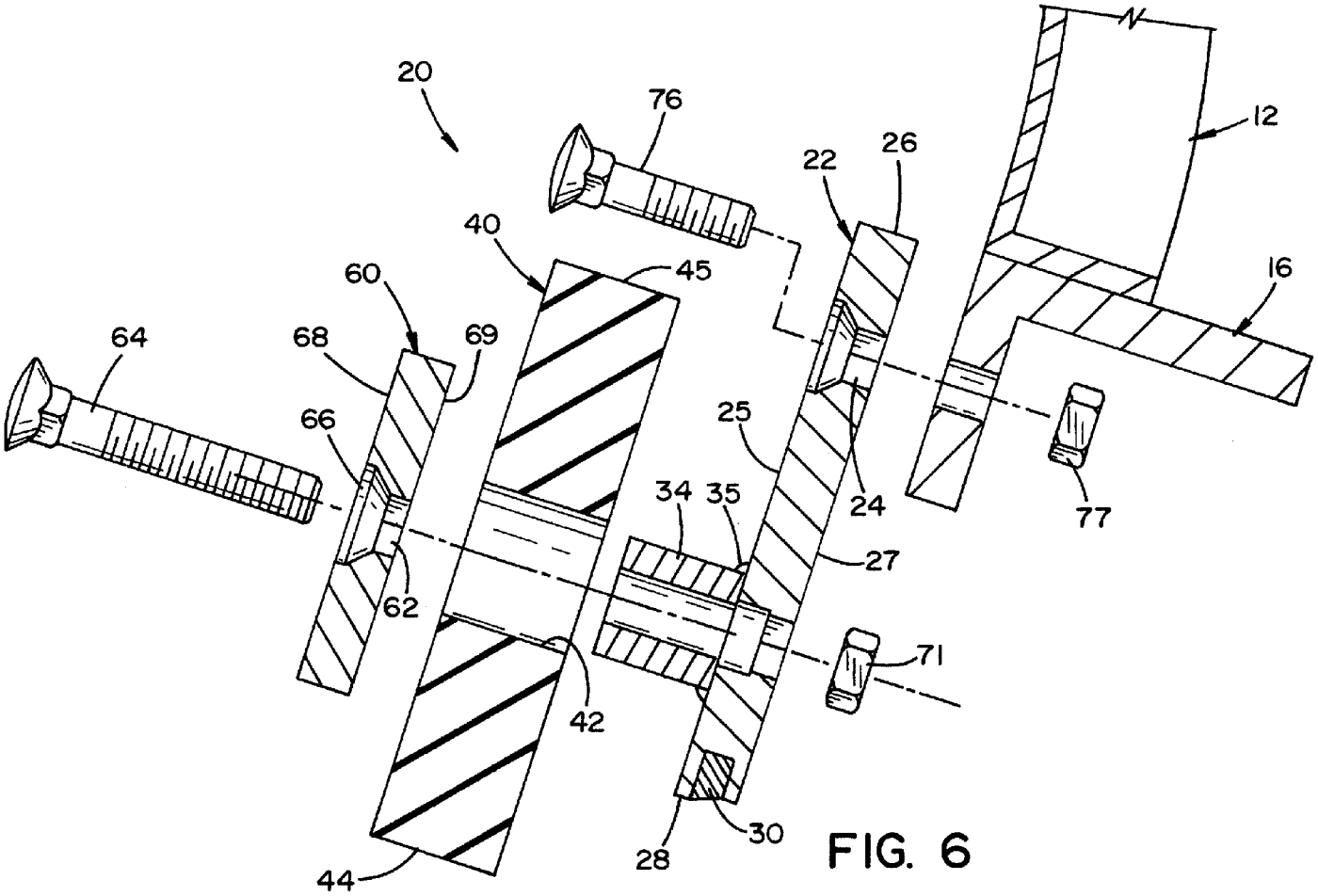
FIG. 6 is an exploded cross sectional view according to the first mounting arrangement.
Figure 7:
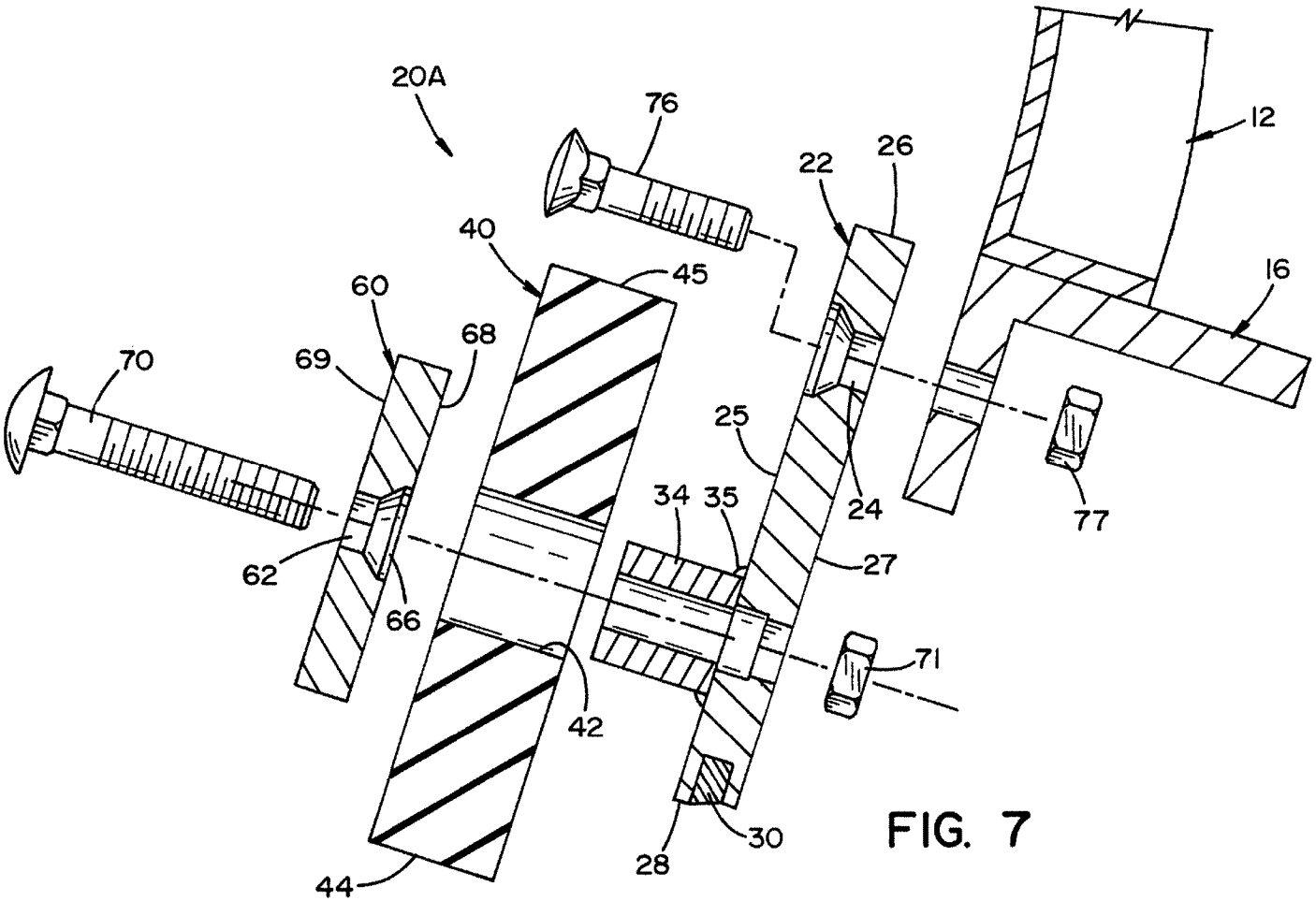
FIG. 7 is an exploded cross sectional view according to a second mounting arrangement.
Figure 8:
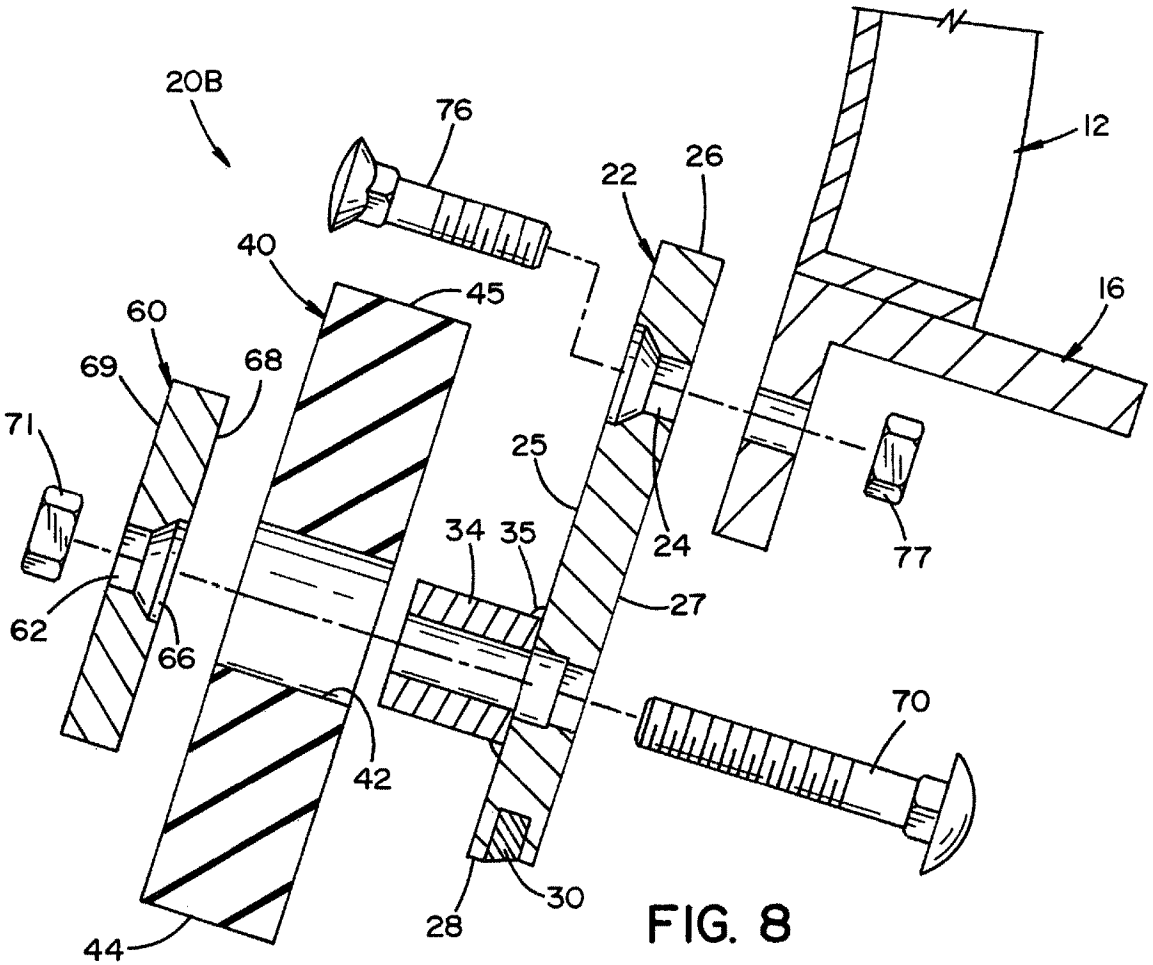
FIG. 8 is an exploded cross sectional view according to a third mounting arrangement.

As shown in FIGS. 6-8, the plow blade edge system 20 can be attached to the plow body 12 in a number of arrangements. A means of mechanical fastening, for example, a plurality of nuts 71 and bolts 64, 70 as shown in FIGS. 6-8 can be provided to fasten the clamp bar 60 (FIG. 5) to the adapter blade 22. The clamp bar 60 includes a series of holes 62 that align with the holes 42 and bushings 34 in the elastomeric plow edge segments and adapter blade segments, respectively. The clamp bar 60 gives support to the elastomeric plow edge segment 40 when plowing and provides a mechanism for keeping the elastomeric plow blade 40 firmly in place. It is to be appreciated that the clamp bar 60 can be reusable and provides a quick and easy method for changing or flipping the elastomeric blade 40 from the first position to the second position. The dimensions of the clamp bar 60 will vary depending upon the size of plow edge used, for example, the length of clamp bar 60 is limitless, but clamp bar 60 typically can have a length from about 3 to about 12 feet. The width or height of clamp bar 60 can be from about 3.0 to about 7.0 inches. The thickness of clamp bar 60 can be from about 0.250 inches to about 1.250 inches. Exemplary lengths include 3, 4, 5, and 6 foot segments. As described above, any number of combinations of these exemplary lengths can be used to accommodate varying sizes of the plow body 12.

Referring to FIG. 6, a first mounting arrangement kit 20 is therein shown and can include a plow bolt 64 extending through a countersunk hole 66 in a first side 68 of the clamp bar 60. As shown, the first side 68 of the clamp bar includes countersunk holes 66 about the mounting holes 62. The plow bolt 64 and nut 71 secures the clamp bar 60 with the adapter blade 22.

Referring to FIG. 7, a second mounting arrangement kit 20A is therein shown and includes a carriage bolt 70 and nut 71, or similar, which can be used for mounting the clamp bar 60 in a second position to the adapter blade 22. In this arrangement, the carriage bolt 70 extends through a square side of hole 62 provided onto a second side 69 of the clamp bar 60.

Referring to FIG. 8, a third mounting arrangement kit 20B is therein shown and includes the carriage bolt 70 and nut 71 which can be used for mounting the clamp bar 60 to the adapter blade 22. In this arrangement, the carriage bolt 70 extends through a rear side 27 of the adapter blade 22 and is secured with nut 71 wherein the clamp bar 60 is in the second position.

The aforementioned plow blade edge system 20, 20A, 20B simplifies mounting thereby reducing maintenance time. The mounting method also eliminates the annoying time consuming adjustments needed with prior art slotted mounting hole designs. The method for replacing an existing plow edge with the elastomeric plow edge system or plow blade edge kit 20, 20A, 20B comprises mounting the adapter blade 22 to the mold board 16, attaching the elastomeric plow edge 40 to the adapter blade 22 in one of a first position or a second position, and then connecting the clamp bar 60 to the adapter blade 22 wherein the elastomeric plow edge 40 is secured between the adapter blade 22 and the clamp bar 60. Once the first edge 44 has worn, the elastomeric plow edge 40 can be reversed by disconnecting the clamp bar 60 from the adapter blade 22, flipping the elastomeric blade 40 from the first position to the second position. The second position exposes the unworn edge or second edge 45 of the elastomeric plow blade 40. Once the elastomeric plow blade 40 has been reversed, the clamp bar 60 can be reconnected to the adapter blade 22. After the second edge 45 has worn, the used plow edge segment 40 can be replaced with a new plow edge segment.

According to one aspect of the present disclosure, plow blade edge kit 20, 20A, 20B can be attached to mold board 16 via adapter blade 22 by means of mechanical fasteners, for example, a plurality of bolts 76 and nuts 77, as shown in FIGS. 6-8. Plow blade edge kit 20, 20A, 20B can include a plurality of slotted mounting holes (not shown) or a plurality of mounting holes 24. The mounting holes 24 will typically have a diameter from about 0.5 inches to about 2.0 inches. Slotted mounting holes will typically have a width from about 0.5 inches to about 3.5 inches and a length from about 2 inches to about 6 inches. The mounting holes 24 and slotted mounting holes are typically equally-spaced along the plow component segments, for example, equally-spaced on about 10-inch, 12-inch, or 14-inch centerlines.

In another embodiment 20C (FIG. 9), an elastomeric plow edge segment 140 can comprise a 'z' shaped, or similar, configuration. One leg 141 of the plow segment 140 can extend below adapter blade 22 and another leg 142 can extend above a clamp or scarifier bar 160. The dimensions of elastomeric blade 140 will vary depending upon the size of plow body 12 used, for example, the length of plow edge segment 140 is limitless, but edge segment 140 typically will have a length from about 3 feet to about 12 feet. The width or height of blade 140 can be from about 4.0 inches to about 12.0 inches. The thickness of blade 140 can be from about 0.50 inches to about 3.0 inches. Exemplary embodiments include elastomeric plow blade segments 140 of 3, 4, 5, and 6 foot lengths. In this manner, any combination of two, or three, blade segments 140 can be combined to extend across mold board 16 of 6, 7, 8, 9, 10, 11, and 12 foot lengths. The aforementioned lengths of plow edge segments 140 provide ease of handling and ease of mounting to the adapter blade 22. The plow edge segments 140 can be easily handled and mounted by one person. The plow edge segments 140 can be stacked, and staggered, one upon the other in a storage orientation. In this manner, the mounting faces of the plow edge segments 140 retain a generally planar orientation for ease of mounting.

A means of mechanical fastening, for example, similar to FIGS. 6-8 can be provided to fasten a scarifier bar 160 (FIG. 9) to the adapter blade 22. The scarifier bar 160 includes a series of holes 162 that align with the holes and bushings in the elastomeric plow edge segments 40, 140 and adapter blade segments, respectively. The scarifier bar 160 gives support to the elastomeric plow edge segment 40, 140 when plowing and provides a mechanism for keeping the elastomeric plow blade 40, 140 firmly in place. It is to be appreciated that the scarifier bar 160 can be turned or flipped over which provides a quick and easy method for changing or flipping the elastomeric blade 40, 140 from a first position to a second position, and also providing another mounting position for bar 160. The dimensions of scarifier bar 160 will vary depending upon the size of plow edge used, for example, the length of scarifier bar 160 is limitless, but scarifier bar 160 typically can have a length from about 3 to about 12 feet. The width or height of scarifier bar 160 can be from about 3.0 to about 7.0 inches. The thickness of scarifier bar 160 can be from about 0.250 inches to about 1.250 inches. Exemplary lengths include 3, 4, 0.5, and 6 foot segments. As described above, any number of combinations of these exemplary lengths can be used to accommodate varying sizes of the plow body 12.

Figure 9:
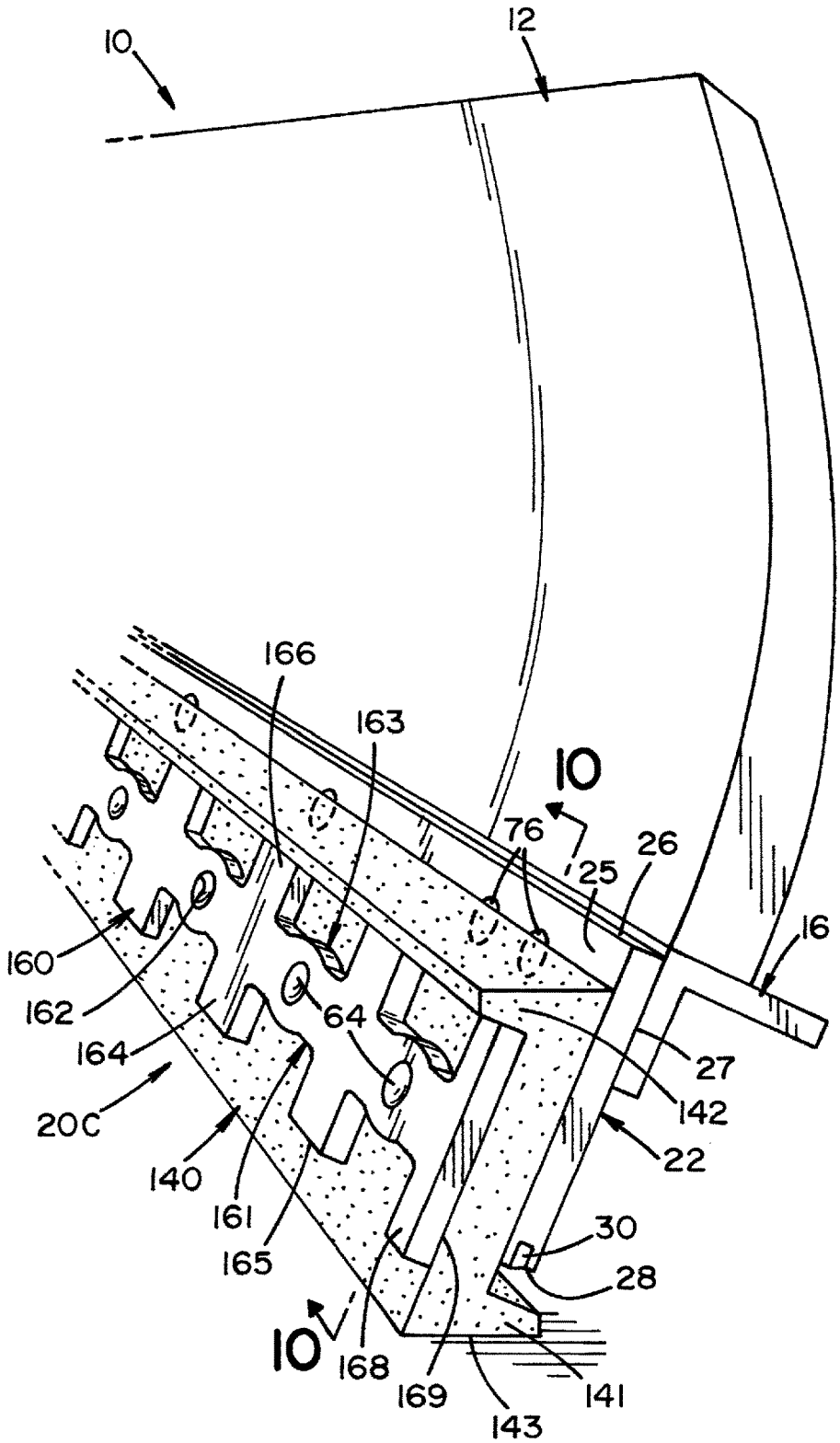
FIG. 9 is a perspective view of a plow blade according to a second embodiment of the present disclosure.
Figure 10:
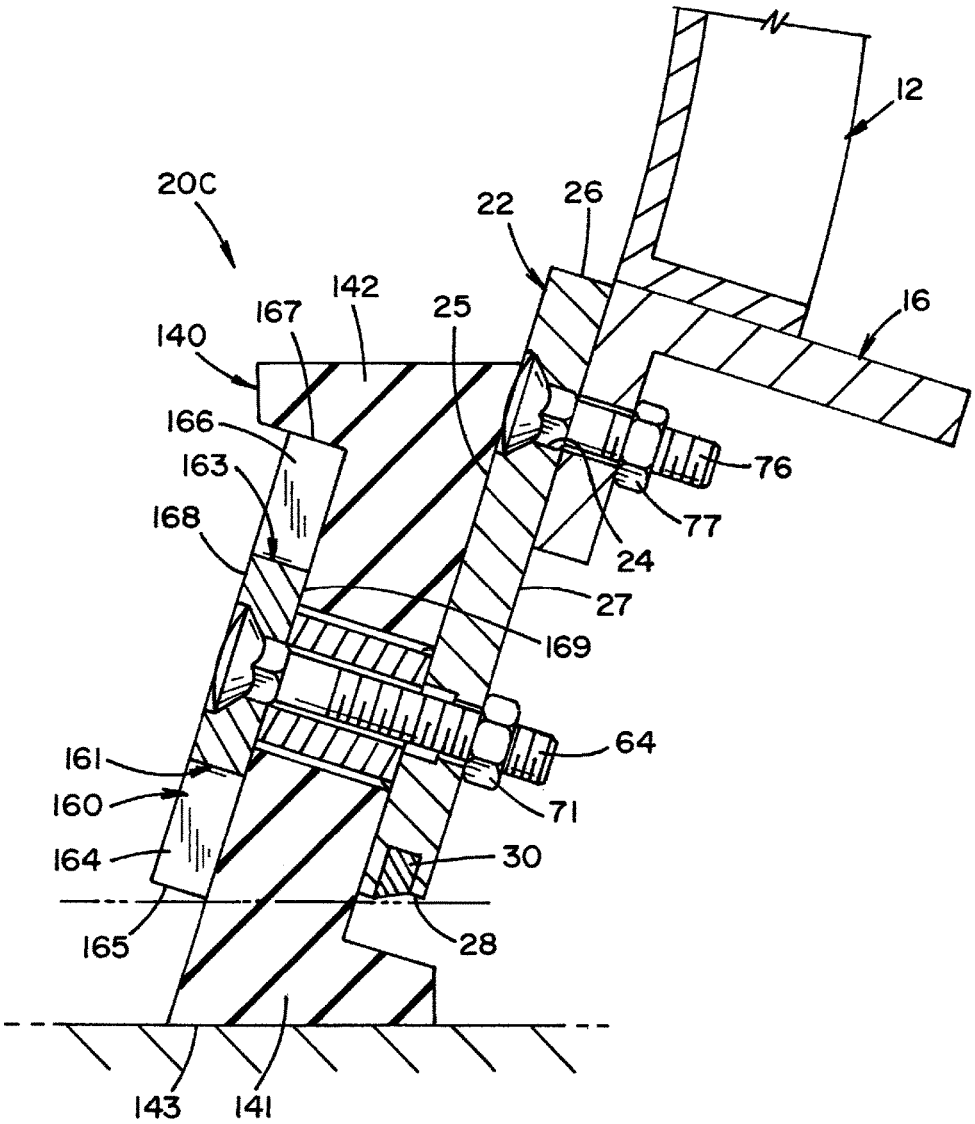
FIG. 10 is a cross sectional view taken along section lines 10-10 in FIG. 9.
Figure 11:
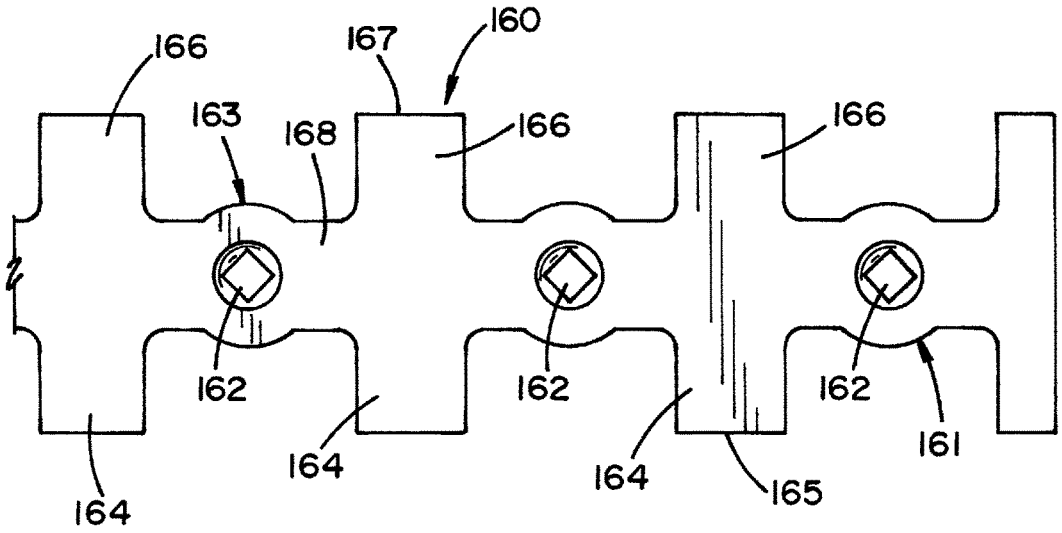
FIG. 11 is a plan view of a scarifier bar.

It is to be appreciated, that in use, elastomeric blade 140, and/or legs 141, 142 will wear to the point that a bottom edge 143 of blade 140 will generally be aligned with a bottom edge 165 of bar 160 and the bottom edge 28 of adaptor blade 22 (in one mounting arrangement). In this manner, edges 165, 143, and 28 will generally be aligned and proximal to, or in contact with, the road or underlying surface. On one side, a lengthwise scarified edge 161 can include an interrupted edge surface including a plurality of teeth 164 having edges 165 proximal to the road or underlying surface. On another opposing side, and in another mounting orientation, a lengthwise scarified edge 163 can include an interrupted edge surface including a plurality of teeth 166 having edges 167 proximal to the road or underlying surface (FIGS. 9-11).

It is to be appreciated that bar 160 can be mounted in four different orientations (not shown). A first orientation includes face 168 facing outward and edge 165 in a downward position. A second orientation includes face 168 facing outward and edge 167 in a downward position. A third orientation includes face 169 facing outward and edge 165 in a downward position. And a fourth orientation includes face 169 facing outward and edge 167 in a downward position. The bar 160 can thus be rotated (i.e. superimposed) lengthwise and rotated widthwise to position each edge 165, 167 in two different directions (orientations) in order to enable even wear and to extend the life of bar 160.

Edge surfaces 165, 167 engaging, or proximal to, the underlying surface represent a minority of the overall length of edge surfaces 161, 163. In one embodiment, the overall edge surfaces 165, 167 comprise less than one-half of the overall length of edge surfaces 161, 163, respectively. In another embodiment, the overall edge surfaces 165, 167 comprise less than one-third of the overall length of edge surfaces 161, 163, respectively. The edges 165, 167 provide a hardened surface for engaging and disturbing hardened material (i.e. packed snow and ice) that are in the path (i.e. upstream) of the moving plow. The aforementioned arrangement provides the benefits of having hardened edges 165, 167 for breaking up material, an elastomeric blade edge 143 for moving fluids and quieting the plow, and a carbide reinforced edge 28 for wear resistance. The combination of edge surfaces 165, 28 sandwiching edge 143 provides the functional advantages of improving the movement of solid and fluid materials in the path of the plow blade while quieting and reducing the impact forces therefrom. Edge surfaces 165, 167, 28 provide hardened edges upstream and downstream from edge 143 thus providing the benefits of durability and wear resistance, while maintaining the benefits of an elastomeric edge.

Figure 12:
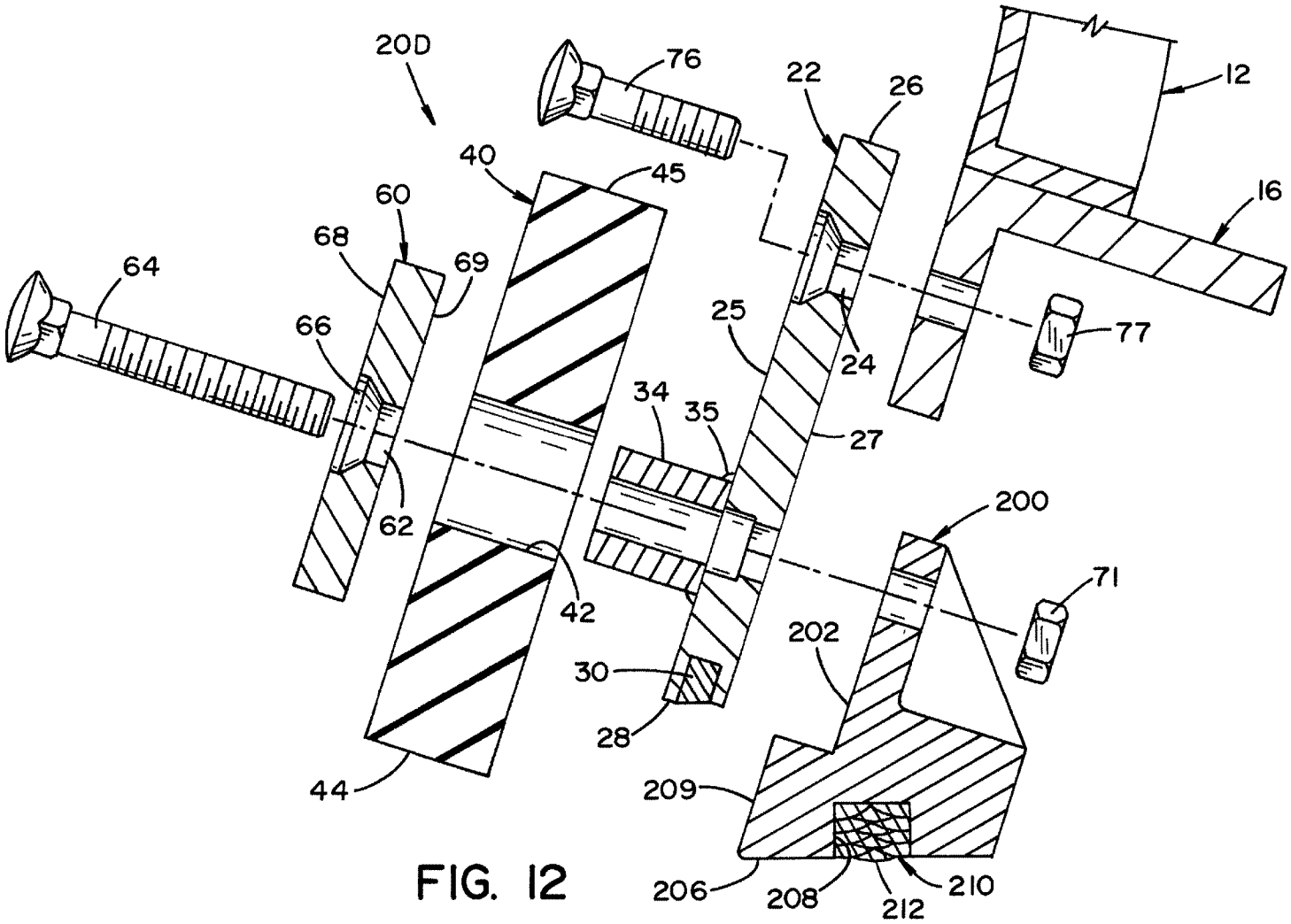
FIG. 12 is an exploded cross sectional view of a plow blade according to a third embodiment of the present disclosure.

Referring to FIG. 12, another embodiment for a plow blade edge kit 20D is therein shown. Mold board or skid shoes 200 can be added to reduce the extensive vibration and the abrasive action between the bottom edges of blades 22, 40 and the road bed over which the snow plow travels. In one mounting arrangement (not shown), a pair of mold board shoes 200 can be mounted on opposing ends of a plow blade or portions of a blade. The skid shoes 200 can include a mounting face 202 which can be secured to the rear side 27 of adapter blade 22 with plow bolt 64 and nut 77. The moldboard shoes 200 can be mounted close to the cutting edges of the snow plow blade system. The mold board shoes 200 can be bolted to the adapter blade 22 such that the adapter blade 22, moldboard shoes 200, elastomeric member 40, and clamp bar 60 can be combined in a plow blade edge system unit wherein individual components can be replaced, added, and/or removed as desired.

The mold board shoes 200 can include generally lateral skid or wear surfaces 206. At least one cavity 208 can be cast into the mold board shoes 200 at the time of casting. The mold board shoes 200 can be cast from steel for greater strength and resiliency. A carbide matrix wear pad 210 can be welded into the cavity 208 to provide improved impact performance, wear resistance, and longer life to the plow blade edge system.

In one mounting arrangement (not shown), the skid shoes 200 can be bolted proximal to opposing ends of the adapter blade 22 (i.e. for a 4 foot length adapter blade). In another mounting arrangement (not shown), a single skid shoe 200 can reside proximal to the center of an adapter blade 22 (i.e. for a 3 foot length adapter blade). The skid shoes 200 reside close to the blade cutting edges and are thus a more integral part of the blade system and therefore, capable of absorbing more of the undesirable abrasive wear and vibration, and capable of providing support to the 'working' edge of elastomeric segment 40. It is to be appreciated that in the mounted position, a front edge 209 of shoe 200 is proximal to a backside of elastomeric blade 40 thereby providing support thereto.

The steel casting of the mold board shoes 200 can take on the following analysis (balance iron).

| C | Mn | P | S | Si | Cr | B | Hardness Bhn |
|---|---|---|---|---|---|---|---|
| ×100<br>16 | ×100<br>140 | ×1000<br>16 | ×1000<br>16 | ×100<br>525 | ×100<br>26 | ×100<br>0.4 | 363/401 |

Subsequent to casting, the cavities 208 can be filled and/or overfilled by welding therein a layered carbide matrix or weldment 210. The layered carbide matrix 210 can be composed of a series of layered deposits one on top another until the cavity 208 is filled or overfilled. Overfilling the cavity 208 can result in a convex or bulbous layer 212 of carbide matrix 210 terminating beyond, i.e. extending below, the wear surface 206 of the mold board shoes 200. The matrix provides a reconstitutable embedded weldment or resistor for increased wear resistance of the wear surface 206. In one exemplary embodiment, one longitudinal cavity extends along substantially the length of the wear surface 206.

The weldments can comprise a weight of between 0.5 and 2 pounds. The weldments can increase the weight of each shoe 200 from about 2% to about 10%. The weldments can be aligned with the wear surface 206 such that when the plow is in use and traveling along the road surface, the weldments are transverse to the direction of travel. Alternatively, the weldments can be aligned with or canted to, the direction of travel.

The weld deposits 210 can have the following analysis (balance iron):

| C | Cr | Mo | Si | Mn | Hardness/Rc 55-60 |
|---|---|---|---|---|---|
| X100<br>2.60 | X100<br>12.00 | X100<br>0.62 | X100<br>1.37 | X100<br>.77 | |

Conventional hard-facing or wear-facing weldments can be used for the deposits. So-called chrome carbide steels are the most common, e.g., Stoody Company No. 121, although vanadium carbide (Stoody No. 134) and tungsten carbide ones also can be used very effectively. It is to be appreciated that the weldment material 210 deposited in the cavity 208 has a higher hardness than the steel casting.

The weldment metal 210 must be abrasion-resistant. Generally, it is a high chrome ferrous metal weld. It is reconstitutable in the sense that it can be repaired or replaced by redeposition of carbide matrix by welding.

The wear surface 206 and the embedded or integrated weldments 210 help to support the cutting edges of the blade such that the abrasive action and impact from the roadbed works on the wear surfaces 206 and weldments 210 of the skid or moldboard shoes 200 instead of the other component edges, thereby substantially prolonging the life of the cutting edges. In addition, the weldments 210 substantially prolong the life of the associated shoe 200 due to the wear surface 206 being a combination of carbide matrix and steel casting.

The surface area of the weldments 210 can comprise from about 10% to about 20% of the total surface area of the bottom wear surface 206.

The present disclosure provides an elastomeric, plow blade edge kit 20, 20A, 20B, 20C, 20D for use in a plow on any form of media. The present disclosure may be used for moving dirt, snow, slush, gravel, sand, blacktop, sawdust, manure, and fluids (including water, paint, petroleum-based fluids, food products, among other fluids), among other materials. The plow blade edge according to the present disclosure is more durable and less prone to damage and require less frequent replacement than prior art plow blade edges. The resilient construction of the present disclosure also transmits less load to vehicles, vehicle mounting equipment, and vehicle operators than prior art plow blade edges. In addition, the resilient plow blade edges according to the present disclosure is more effective when plowing non-rigid media, for example, slush and water, compared to rigid metallic prior art plow blade edges. The sandwiched elastomeric blade reduces 'chatter' from the other mated bars and blades mounted thereto in the plow blade edge system, and reduces 'chatter' from the road surface below. Impact forces from the road surface are also dampened with the aforementioned edge system.

Yet still another embodiment of a plow blade edge kit assembly, or system 20E is shown in FIGS. 13-18, wherein an elastomeric plow edge or blade segment 240 can comprise a rectilinear shaped, or similar, configuration. The dimensions of elastomeric blade 240 will vary depending upon the size of plow body 12 used, for example, the length of plow edge segment 240 is limitless, but edge segment 240 typically will have a length from about 3 feet to about 12 feet. The width or height of blade 240 can be from about 4.0 inches to about 12.0 inches. The thickness of blade 240 can be from about 0.50 inches to about 3.0 inches. Exemplary embodiments include elastomeric plow blade segments 240 of 3, 4, 5, and 6 foot lengths having 6.0 to 8.0 inch height, and 1.0 to 2.0 inch thickness. In this manner, any combination of two or more blade segments 240 can be combined to extend across plow bodies 12 having 6, 7, 8, 9, 10, 11, and 12 (et. al.) foot lengths. To be described in more detail hereinafter, the aforementioned lengths of plow edge segments 240 provide ease of handling and ease of mounting with an adapter blade 222 to mold board 16. The components in the plow edge kit 20E can be easily handled and mounted by one person. The plow edge segments 240 can be stacked, and staggered, one upon the other in a storage orientation. In this manner, the mounting faces of the plow edge segments 240 retain a generally planar or flat orientation for improved storage arrangements, ease and efficiency of mounting, and improved performance.

A means of mechanical fastening can be provided to fasten a clamp bar 260 (FIGS. 13-15), the elastomeric blade 240, and the adapter blade 222 to the mold board 16. The clamp bar 260 (FIG. 18) can include a series of holes 272 that align with the holes and bushings in the elastomeric plow edge segments 240, adapter blade 222 segments (FIG. 16), and the mold board 16, respectively. The bar 260 gives support to the elastomeric plow edge segment 240 when plowing and provides a mechanism for keeping the elastomeric plow blade 240 firmly in place. During mounting the clamp bar 260 can be held in place adjacent to elastomeric bar 240 by mounting tabs 274, 275. Opposing mounting tabs 274, 275 located on distal ends of the bar 260 provide a temporary holding mechanism by placing tabs 274, 275 in corresponding mounting holes 284, 285 in elastomeric bar 240.

Figure 13:
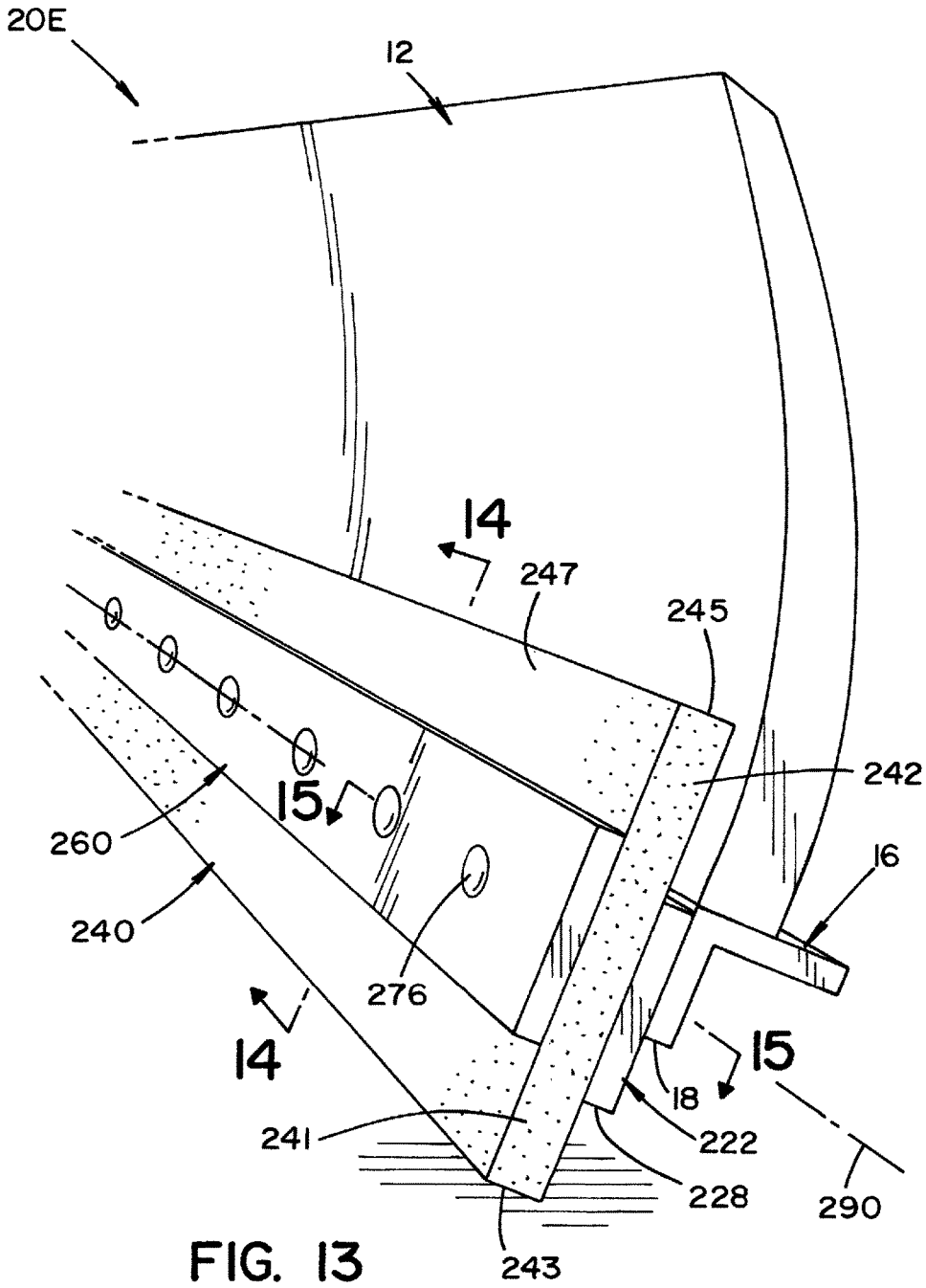
FIG. 13 is a perspective view of a plow blade according to a fourth embodiment of the present disclosure.
Figure 14:
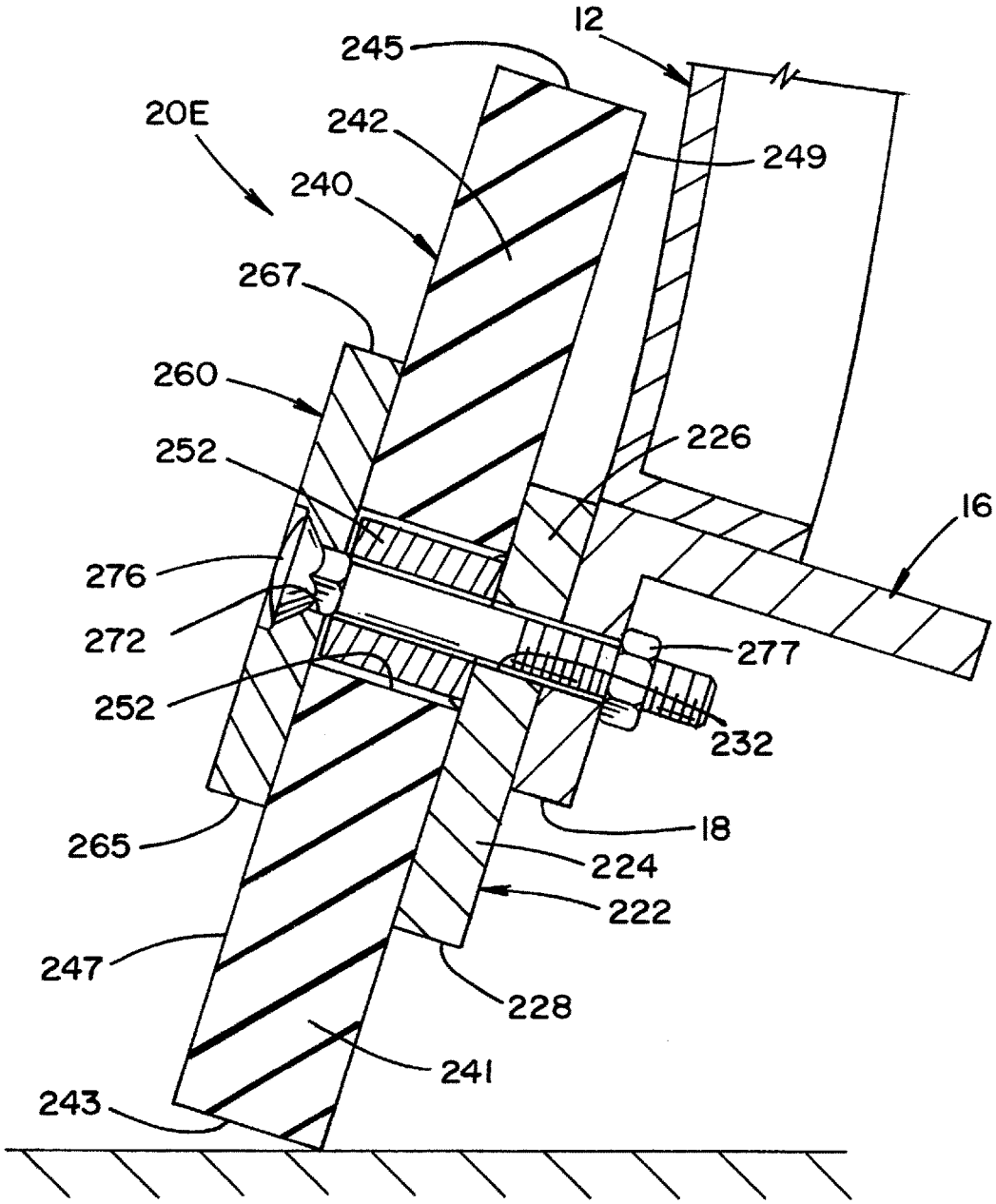
FIG. 14 is a cross sectional view taken along section lines 14-14 in FIG. 13.
Figure 15:
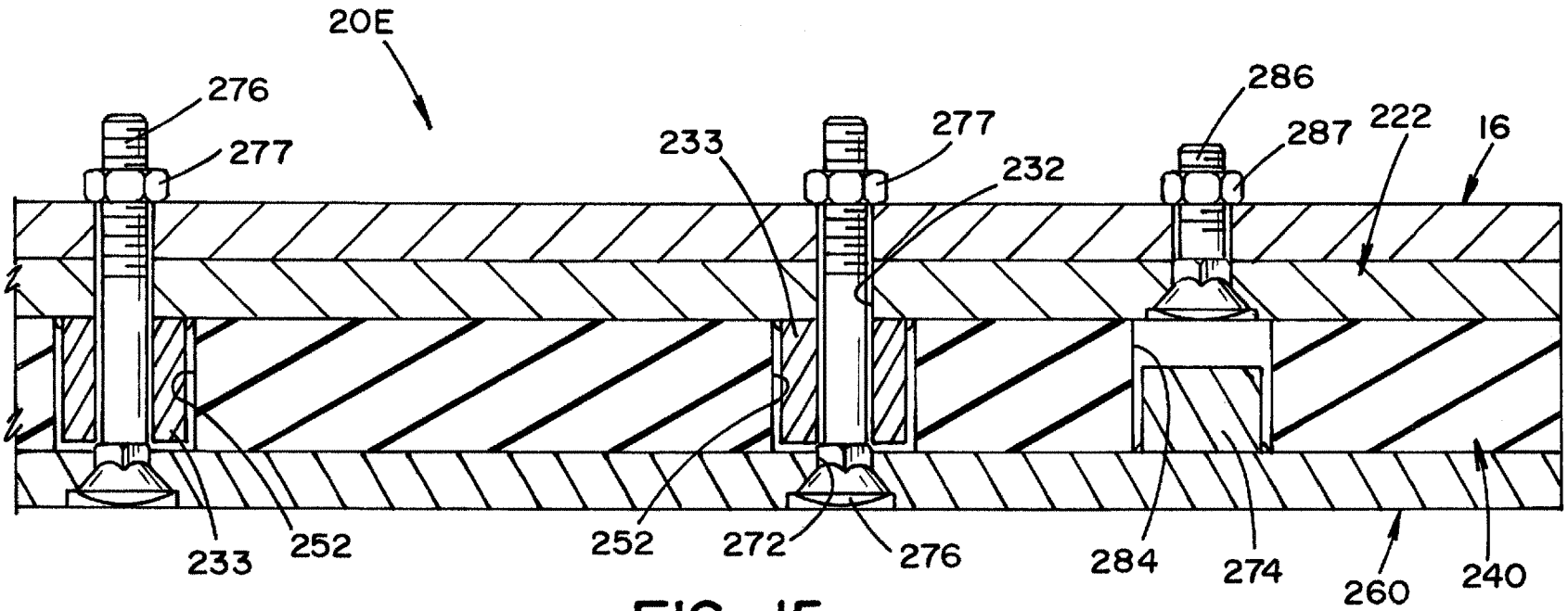
FIG. 15 is a cross sectional view taken along section lines 15-15 in FIG. 13.
Figure 16:
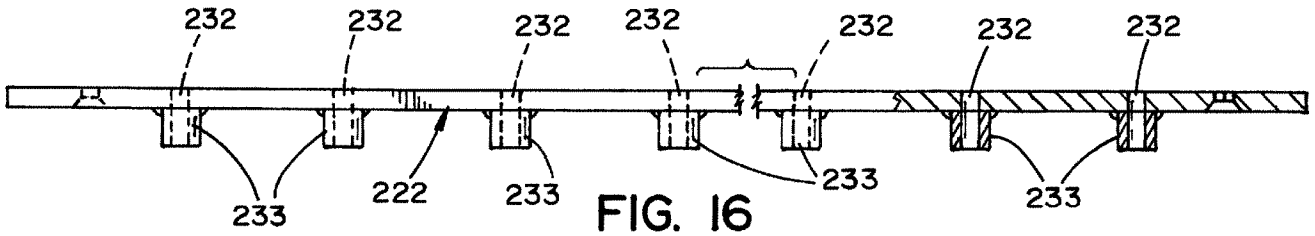
FIG. 16 is a side view (partial cross section) of another version of an adapter blade.
Figure 17:
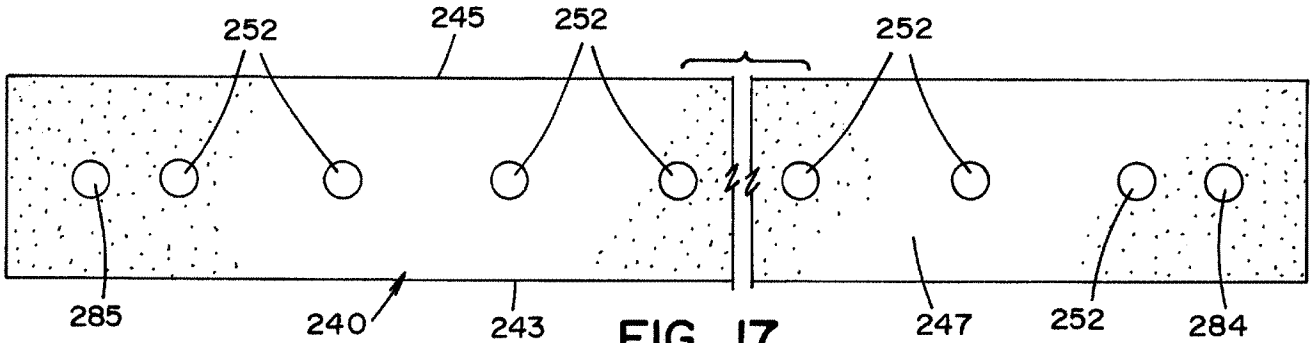
FIG. 17 is a plan view of another version of an elastomeric blade.
Figure 18:
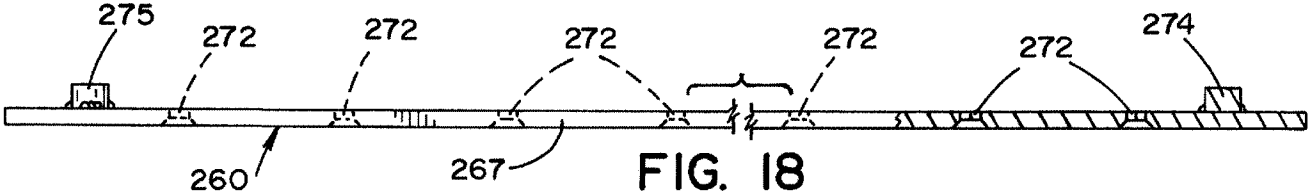
FIG. 18 is a side view (partial cross section) of another version of a clamp bar.
Figure 19:
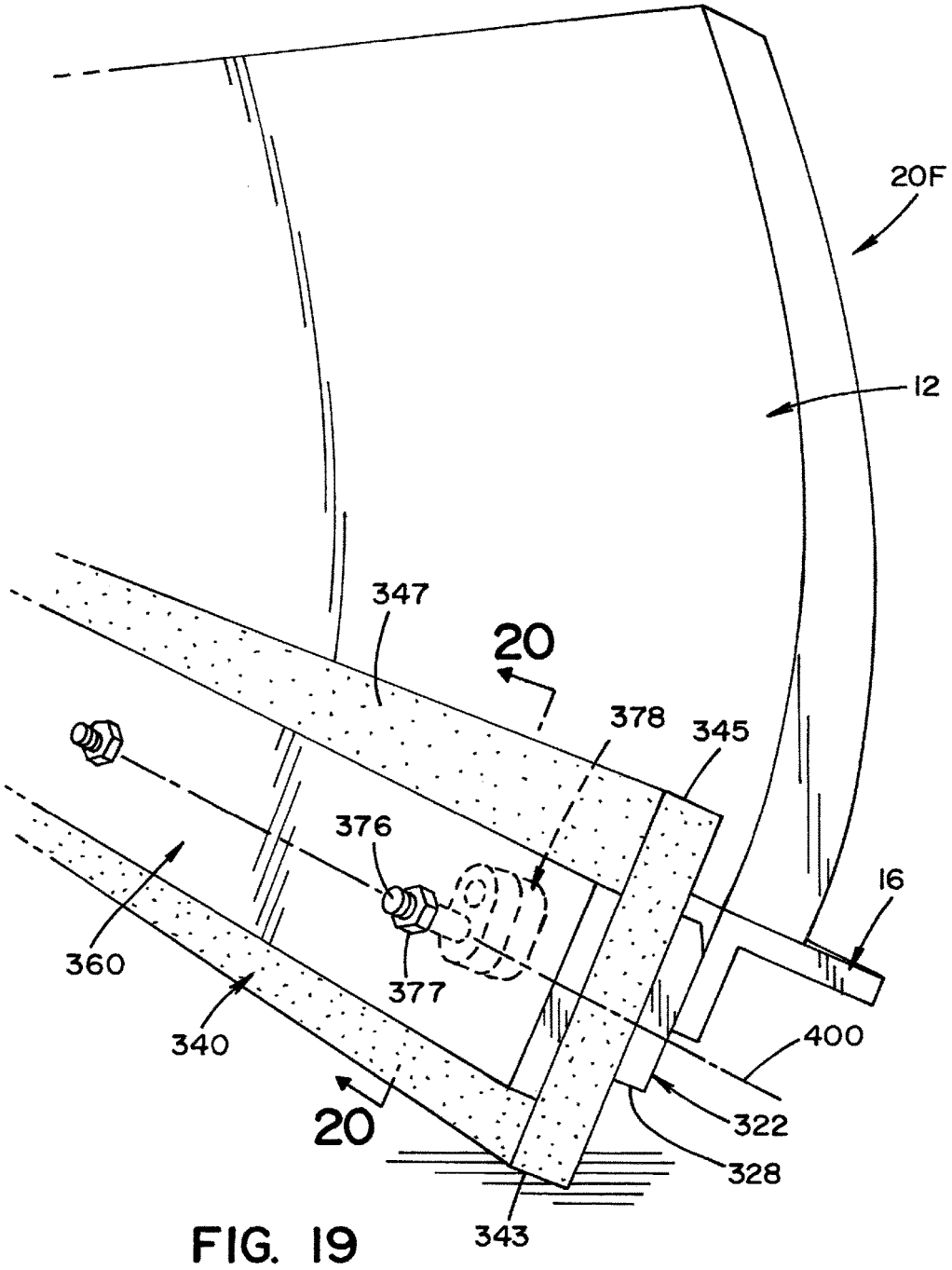
FIG. 19 is a perspective view of a plow blade according to a fifth embodiment of the present disclosure.
Figure 20:
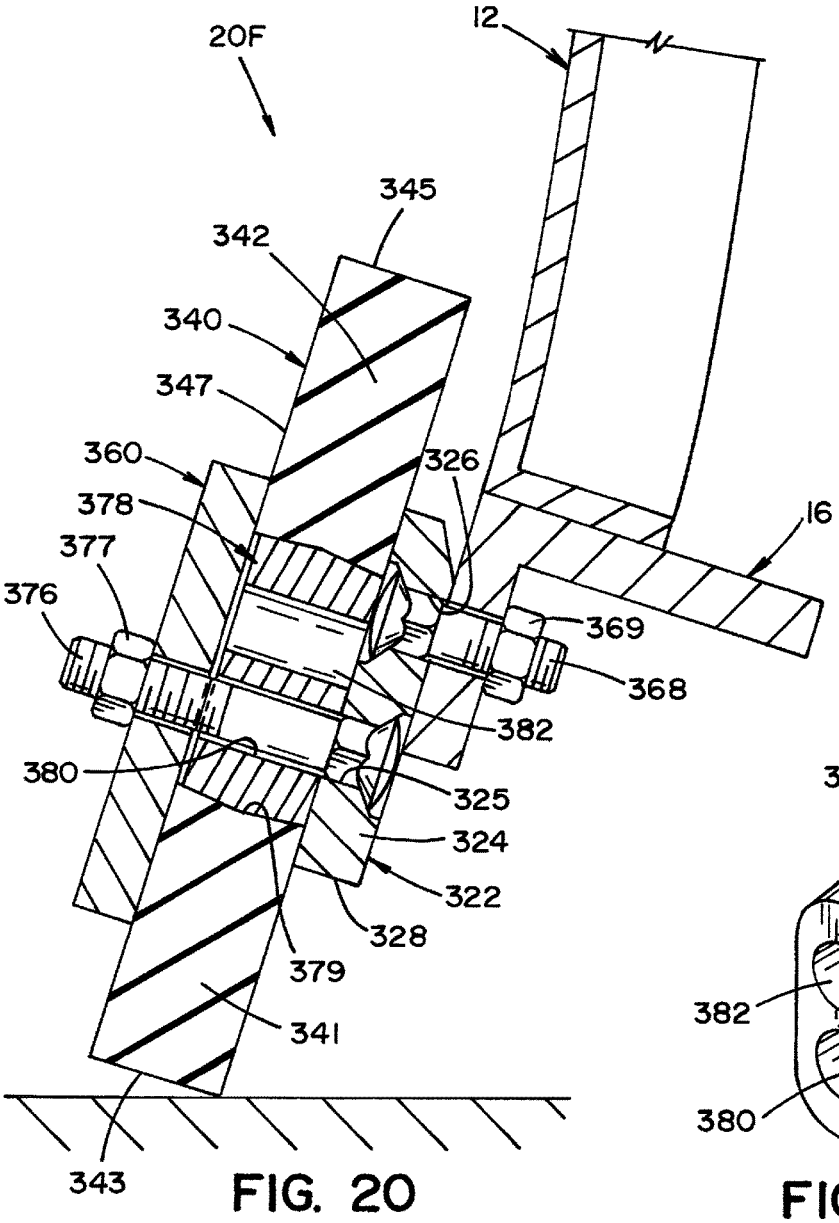
FIG. 20 is a cross sectional view taken along section lines 20-20 in FIG. 19.
Figure 21:
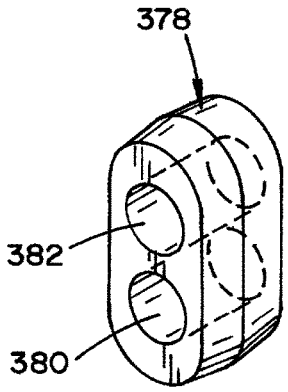
FIG. 21 is a perspective view of a first mounting bushing.
Figure 22:
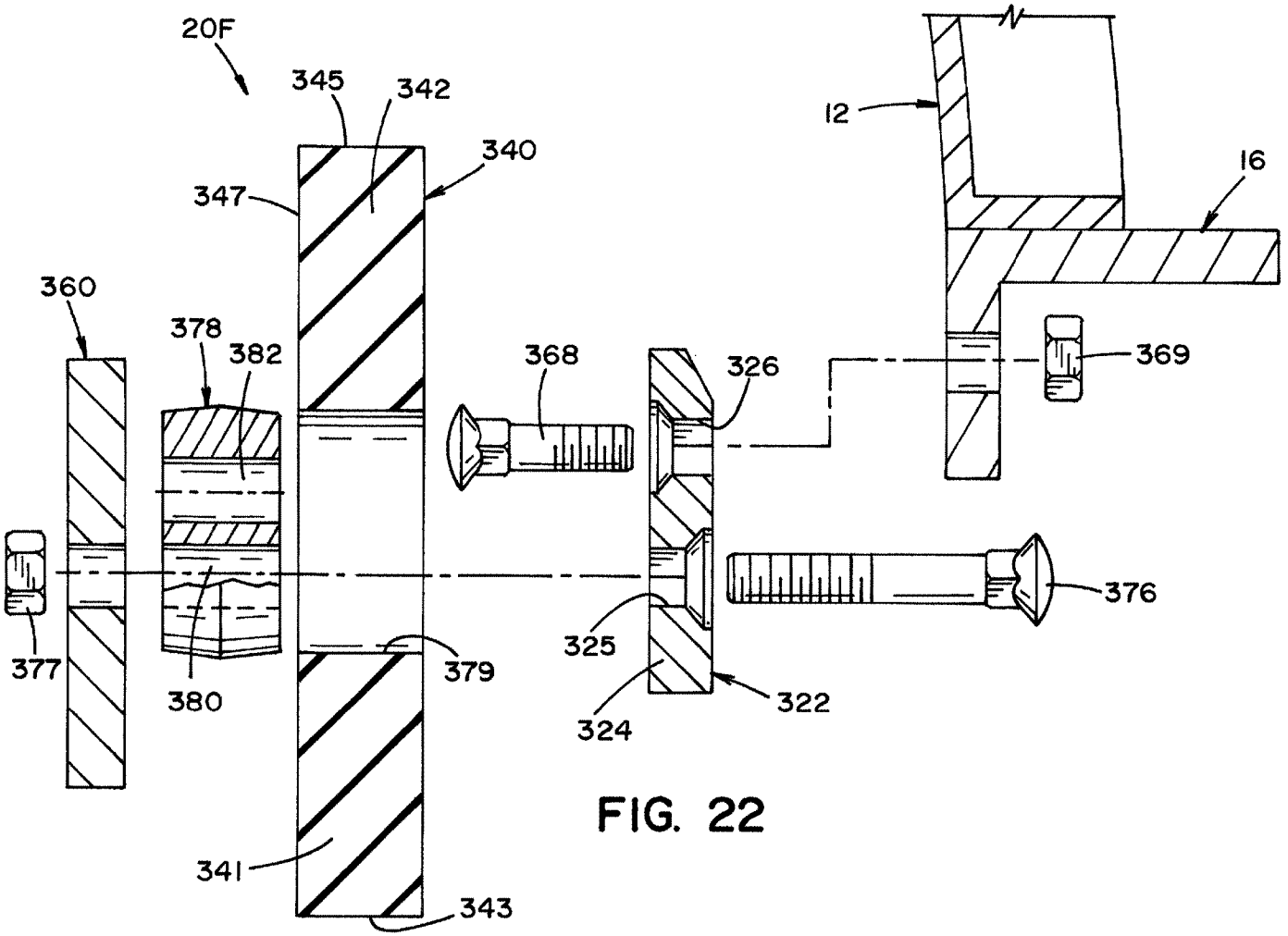
FIG. 22 is an exploded cross sectional view of a plow blade according to a fifth embodiment of the present disclosure.
Figure 23:
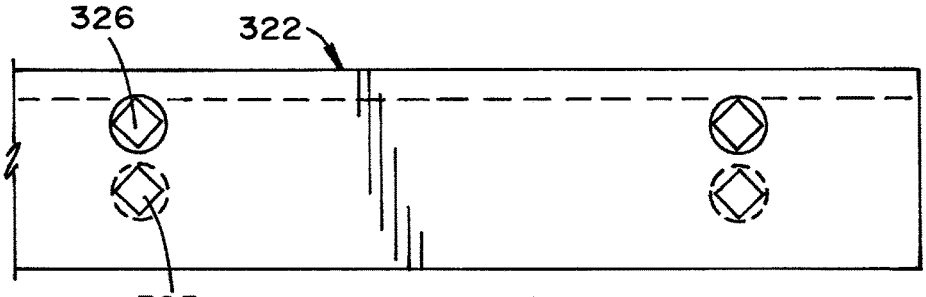
FIG. 23 is a plan view of an adapter blade respectively.
Figure 24:
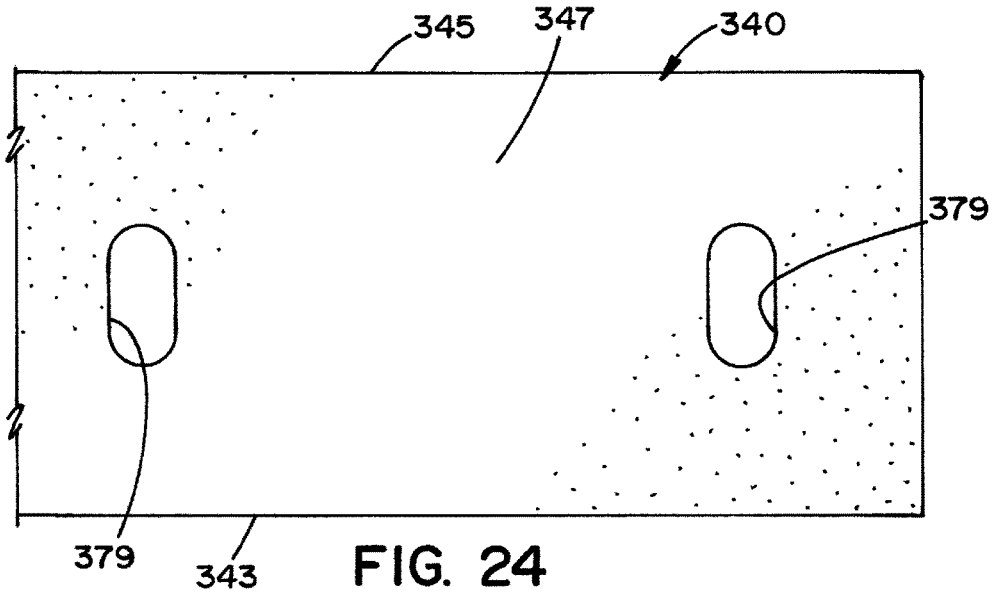
FIG. 24 is a plan view of an elastomeric blade respectively.
Figure 25:
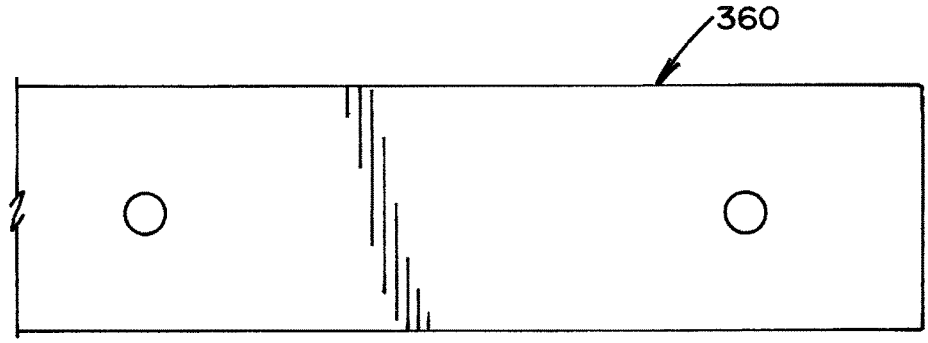
FIG. 25 is a plan view of a clamp bar respectively.

Plow blade edge or assembly kit 20E can be attached directly to mold board 16 as a complete system by means of mechanical fasteners, for example, a plurality of bolts 276 and nuts 277, as shown in FIGS. 13-14. Adapter blade 222 can include a plurality of slotted mounting holes (not shown)

or a plurality of mounting holes 232. The mounting holes 232 will typically have a diameter from about 0.5 inches to about 2.0 inches. Slotted mounting holes will typically have a width from about 0.5 inches to about 3.5 inches and a length from about 2 inches to about 6 inches. The mounting holes 232 are typically equally-spaced along the plow component segments. Mounting holes 232, 252, 272 are aligned along their respective bars 222, 240, 260 for receiving bolts 276 and for mounting to mold board 16. The elastomeric bar 240 can be held temporarily in place by mounting bushings 233 which are aligned with corresponding mounting holes 252 in elastomeric bar 240. The mounting bushings 233 are retained inside corresponding mounting holes 252 in elastomeric bar 240 for temporary retention of elastomeric bar 240 adjacent to adapter blade 222. It is to be appreciated, that during mounting, bolts 276 can be passed (in turn) through clamp bar 260, elastomeric blade 240, adapter blade 222, and mold board 16. A nut 277 can then be fastened to bolt 276 for securing components 260, 240, 222 to mold board 16.

It is to be appreciated that the clamp bar 260 can be turned or flipped over which provides a quick and easy method for changing or flipping the elastomeric blade 240 from a first position to a second position, and also providing another mounting position for bar 260. The dimensions of bar 260 will vary depending upon the size of plow edge used, for example, the length of bar 260 is limitless, but bar 260 typically can have a length from about 3 to about 12 feet. The width or height of bar 260 can be from about 3.0 to about 7.0 inches. The thickness of bar 260 can be from about 0.250 inches to about 1.250 inches. Exemplary lengths include 3, 4, 5, and 6 foot segments. As described above, any number of combinations of these exemplary lengths can be used to accommodate varying sizes (i.e. 5 to 12 feet) of the plow body 12.

It is to be appreciated, that in use, elastomeric blade 240, and leg 241, will wear to the point that a bottom edge 243 of blade 240 will generally be aligned with a bottom edge 228 of adaptor blade 222 (in one mounting arrangement). In this manner, edges 243 and 228 will generally be aligned and proximal to, or in contact with, the road or underlying surface. On one side, a lengthwise edge can comprise edge 243 proximal to the road or underlying surface. On another opposing side, and in another mounting orientation, a lengthwise edge can comprise edge 245 proximal to the road or underlying surface (not shown).

It is to be appreciated that bar 240 can be mounted in four different orientations and assembled with the clamp bar 260 and adapter blade 222, and then mounted on mold board 16. A first orientation includes face 247 facing outward and edge 243 in a downward position. A second orientation includes face 247 facing outward and edge 245 in a downward position. A third orientation includes face 249 facing outward and edge 243 in a downward position. And a fourth orientation includes face 249 facing outward and edge 245 in a downward position. The bar 240 can thus be rotated (i.e. superimposed) lengthwise and rotated widthwise to position each edge 243, 245 in two different directions (orientations) in order to enable even wear and to extend the life of bar 240.

The adapter blade 222 can be pre-mounted to mold board 16 and the assembly of plow blade edge kit 20E can to simplify the rotation of elastomeric bar 240 from a worn edge to an unworn edge.

The edges 265 or 267 provide a hardened surface for engaging and disturbing hardened material (i.e. packed snow and ice) that are in the path (i.e. upstream) of the moving plow. The aforementioned arrangement provides the benefits of having a hardened edge 265 or 267 for breaking up material, an elastomeric blade edge 243 or 245 for moving fluids and quieting the plow, and an edge 228 for wear resistance. The combination of edge surfaces 265 or 267, and 228 sandwiching edge 243 provides the functional advantages of improving the movement of solid and fluid materials in the path of the plow blade while quieting and reducing the impact forces therefrom. Edge surfaces 265 or 267, and 228 provide hardened edges upstream and downstream from edge 243 thus providing the benefits of durability and wear resistance, while maintaining the benefits of an elastomeric edge.

In one mounting position, one portion 241 of the plow segment 240 can extend below clamp bar 260 and adapter blade or plate 222, and another portion 242 can extend above the clamp bar 260 and adapter blade 222. The sandwiched elastomeric blade 240, i.e. sandwiched between clamp bar 260 and adapter blade 222, associated with the alternative mounting arrangement detailed in FIGS. 13-14, reduces the 'skipping' of the elastomeric blade 240 as the blade assembly 20E is pushed across a surface. It is to be appreciated that the clamp bar 260 is generally centered on the elastomeric blade 240, whereas the adapter blade 222 is offset relative to the elastomeric blade 240. For example, nearly twice the cross sectional area 224 of the adapter blade 222 falls below a mounting axis 290 relative to the cross sectional area 226 of the adapter blade 222 above the mounting hole. In this mounting arrangement, the edge surface 265 is mounted higher (i.e. away from the ground surface) than both edges 243 and 228. Adapter blade 222, and in particular adapter blade section 224, provides additional support to the backside of elastomeric blade 240 as the blade assembly 20E is pushed across a surface. The alternative mounting arrangement, detailed in FIGS. 13-14, reduces the 'moment arm' of the elastomeric blade 240 about the mounting axis 290 while the assembly 20E is engaged with and pushed along a surface. This reduction in 'moment arm' further reduces skipping of the elastomeric blade 240 while the edge 243 (or 245) is engaged with and pushed along a surface.

Yet still another embodiment of a plow blade edge kit assembly, or system 20F is shown in FIGS. 19-25, wherein an elastomeric plow edge or blade segment 340 can comprise a rectilinear shaped, or similar, configuration. The dimensions of elastomeric blade 340 will vary depending upon the size and type of plow body 12 used, for example, the length of plow edge segment 340 is limitless, but edge segment 340 typically will have a length from about 3 feet to about 4 feet. The width or height of the blade 340 can be from about 4.0 inches to about 12.0 inches. The thickness of blade 340 can be from about 0.50 inches to about 3.0 inches. Exemplary embodiments include elastomeric plow blade segments 340 of 3, 4, 5, and 6 foot lengths having 6.0 inch to 8.0 inch height, and 1.0 inch to 2.0 inch thickness. In this manner, any combination of two or more blade segments 340 can be combined to extend across plow bodies 12 having 6, 7, 8, 9, 10, 11, and 12 (et al.) foot lengths. To be described in more detail hereinafter, the aforementioned lengths of plow edge segments 340 provide ease of handling and ease of mounting with an adaptor blade 322 to mold board 16. The components in the plow edge kit 20F can be easily handled and mounted by one person. The plow edge segments 340 can be stacked, and staggered, one upon the other in a storage orientation. In this manner, the mounting faces of the plow edge segments 340 retain a generally planar or flat orientation for improved storage and handling arrangements, ease and efficiency of mounting, and improved performance.

A means of mechanical fastening can be provided to fasten a clamp bar 360, an elastomeric blade 340, and an adaptor blade 322 to the mold board 16. The clamp bar 360 (FIG. 19) can include a series of holes 372 that align with the plurality of holes and bushings in the elastomeric plow edge segments 340, adaptor blade 322 segments (FIG. 20), and the mold board 16, respectively. The bar 360 gives support to the elastomeric plow edge segment 340 when plowing and provides a mechanism for keeping the elastomeric plow blade 340 firmly in place. During mounting, the clamp bar 360 can be held in place adjacent to elastomeric bar 340 by mounting tabs (not shown). Opposing mounting tabs can be located on distal ends of the bar 360 to provide a temporary holding mechanism by placing the tabs in corresponding mounting holes (not shown) in elastomeric bar 340.

Plow blade edge or assembly kit 20F can be attached directly to mold board 16 as a complete system by means of mechanical fasteners, for example, a plurality of bolts 376, nuts 377, and plug castings or steel bushings 378, as shown in FIGS. 19-22. Adaptor blade 322 can include a plurality of mounting holes 325, 326. Mounting holes 325 can be counter sunk and used for mounting the elastomeric blade 340 and the clamp bar 360 to the adaptor blade 322. Mounting holes 326 can be counter-sunk and provide the means, along with bolts 368 and nuts 369, for mounting the adaptor blade 322 to the mold board 16. It is to be appreciated that the adaptor blade 322 can come in varying lengths (i.e. 3, 4, 5, and 6 feet). The mounting holes 324, 326 can be equally spaced along the plow component segments.

Elastomeric blade 340 can include a slotted opening 379 for retention of the plug casting or steel bushing 378. As shown, a plurality of slotted openings 379 are provided for retaining a plurality of steel bushings 378. Each steel bushing 378 can include at least two independent mounting holes 380, 382 (FIGS. 19-22). The independent mounting holes provide adjustable mounting positions of the elastomeric blade 340 and the clamp bar 360. It is to be appreciated that independent mounting holes 380,382 provide alternative mounting positions and a means for lowering the elastomeric blade 340 relative to the adaptor blade 322 as the elastomeric blade 340 is worn along a lower or working edge. It is to be further appreciated that a first mounting position 380 can be used for initial mounting of the elastomeric blade 340. As wear occurs to a bottom edge 343 of the elastomeric blade 340, the mounting of said elastomeric blade 340 can be moved to a second mounting position 382.

The clamp bar 360 can be easily removed and turned or flipped over which provides a quick and easy method for changing the position of and/or flipping the elastomeric blade 340 from one position to another position, while also providing another mounting position for clamp bar 360. As discussed above, the dimensions of elastomeric blade 340 and clamp bar 360 will vary depending upon the size of plow edge used, for example, the length of bar 360 is limitless, but bar 360 typically can have a length from about 3 feet to about 12 feet, preferably from about 3 feet to about 6 feet.

It is to be appreciated, that in use, elastomeric blade 340, and leg 341, will wear to the point that a bottom edge 343 of blade 340 will be proximal to a bottom edge 328 of adaptor blade 322 (in one mounting position). In this manner, edges 343 and 328 will generally be proximal to, or in contact with, the road or underlying surface. On one side, a length wise edge can comprise edge 343 proximal to the road or underlying surface. On another opposing side, and in another mounting orientation, a length-wise edge can comprise edge 345 proximal to the road or underlying surface (not shown).

It is to be appreciated that bar 340 can be mounted in at least four different positions and assembled with the clamp bar 360 and adaptor blade 322, and then mounted on mold board 16. A first position comprising mounting holes 380 include face 347 facing outward and edge 343 in a downward position. A second position includes face 347 facing outward and edge 343 in a downward position while utilizing the second mounting holes 382. A third position includes face 347 facing outward and edge 345 in a downward position while utilizing mounting holes 382. A fourth position includes face 347 facing outward and edge 345 in a downward position while utilizing mounting holes 380. The elastomeric blade 340 can thus be rotated length-wise to position each edge 343, 345 in two different positions, respectively, in order to enable even wear and to extend the life of elastomeric blade 340. The adaptor blade 322 can be premounted to mold board 16 and the assembly of plow blade edge kit 20F to simplify the changing of position of the elastomeric blade 340 as the blade 340 is worn along the respective edges 343, 345.

The bottom or working edges of the clamp bar 360 and adaptor blade 322 can provide hardened surfaces for engaging and disturbing hardened material (i.e. packed snow and ice) that are in the path (i.e. upstream) of the moving plow. The aforementioned arrangement provides the benefits of having hardened edges for breaking up material, and selectively presentable elastomeric blade edges 343, 345 for removing fluids and quieting the plow. The combination of hardened edge surfaces sandwiching edges 343, 345 provide the functional advantages of improving the movement of solid and fluid materials in the path of the plow blade while quieting and reducing the impact forces therefrom. Edge surfaces of the clamp bar 360 and the adaptor blade 322 can provide hardened edges upstream and downstream from edges 343, 345 thus providing the benefits of durability and wear resistance, while maintaining the benefits of an elastomeric edge.

Mounting holes can be aligned along the respective bars and blades 322, 340, 360 for receiving bolts 368, 376 and for mounting to mold board 16. The elastomeric blade 340 can be temporarily held in place by mounting bushings 378 and bolts 376 which can be aligned with corresponding mounting holes in elastomeric blade 340. The mounting bushings 378 are retained inside corresponding countersunk mounting openings 379 in elastomeric blade 340 for temporary retention to elastomeric blade 340. It is to be appreciated, that during mounting, bolts 376 can be passed (in turn) through adaptor blade 322, elastomeric blade 340, and clamp bar 360. Nuts 377 can then be fastened to bolts 376 for securing components 360, 340, 322 together.

It is to be appreciated that the clamp bar 360 can be turned or flipped over which provides a quick and easy method for changing or flipping the elastomeric blade 340 from the first through the fourth position.

In one mounting position, one portion 341 of the plow segment 340 can extend below clamp bar 360 and adaptor blade or plate 322, and another portion 342 can extend above the clamp bar 360 and adaptor blade 322. The sandwiched elastomeric blade 340, i.e. sandwiched between clamp bar 360 and adaptor blade 322, associated with the mounting arrangement detailed in FIGS. 19-22, reduces the "skipping" of the elastomeric blade 340 as the blade assembly 20F is pushed across a surface. Adaptor blade 322, and in particular adaptor blade section 324, provides additional support to the back side of elastomeric blade 340 as the blade assembly 20F is pushed across a surface. The alternative mounting arrangements and positions, detailed FIGS. 19-22, reduces the "moment arm" of the elastomeric blade 340 about a mounting axis 400 while the assembly 20F is engaged with and pushed along a surface. This reduction in "moment arm" further reduces skipping of the elastomeric blade 340 while the edge 343 or 345 is engaged with and pushed along a surface.

Figure 26:
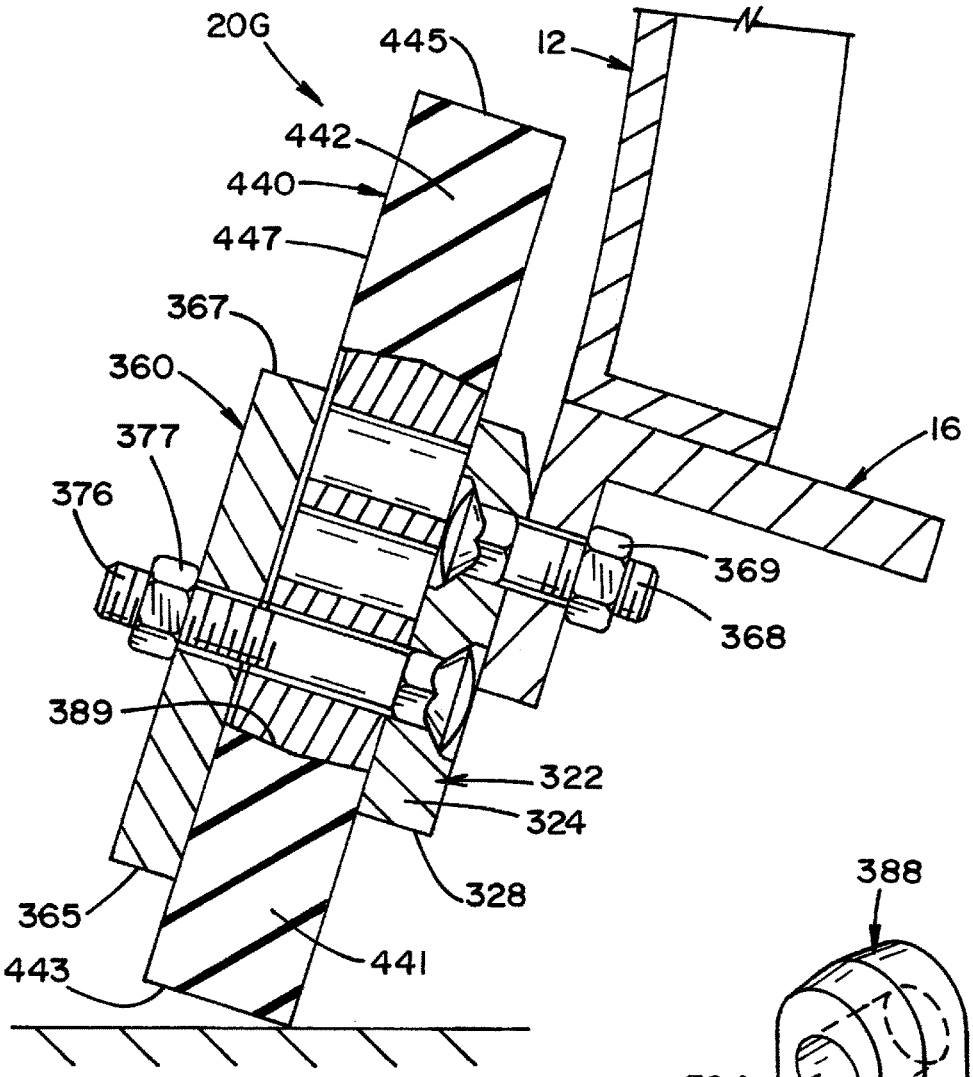
FIG. 26 is a cross sectional view according to a sixth embodiment.
Figure 27:
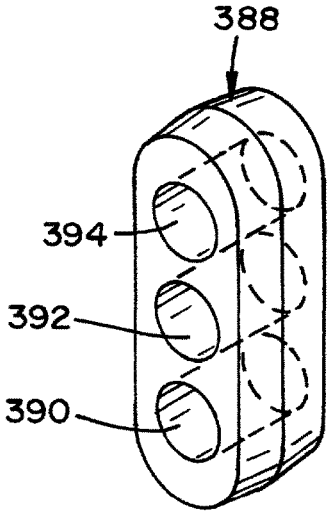
FIG. 27 is a perspective view of a first mounting bushing according to a second embodiment.

In yet another embodiment (FIGS. 26-27), an elastomeric blade 440 can include a slot 389 for retention of a plug casting or steel bushing 388. As shown, a plurality of slotted openings 389 are provided for retaining a plurality of steel bushings 388. The steel bushings 388 can include at least three independent mounting holes 390, 392, 394. The independent mounting holes provide adjustable mounting positions of the elastomeric blade 440 and the clamp bar 360. It is to be appreciated that independent mounting holes 390, 392, 394 provide alternative mounting positions and a means for lowering the elastomeric blade 440 relative to the adaptor blade 322 as the elastomeric blade 440 is worn along a lower or working edge. It is to be further appreciated that a first mounting position 390 can be used for initial mounting of the elastomeric blade 440. As wear occurs to a bottom edge 443 of the elastomeric blade 440, the mounting of the elastomeric blade 440 can be moved to mounting position 392. And further, as additional wear progresses, the elastomeric blade 440 can be repositioned and mounted using mounting holes 394 of the steel bushing 388.

It is to be appreciated, that in use, elastomeric blade 440, and leg 441, will wear to the point that a bottom edge 443 of blade 440 will be proximal to edge 328 of adaptor blade 322 (in one mounting position). In this manner, edges 443 and 328 will generally be proximal to, or in contact with, the road or underlying surface. On one side, a lengthwise edge can comprise edge 443 proximal to the road or underlying surface. On another opposing side, and in another mounting orientation, a lengthwise edge can comprise edge 445 proximal to the road or underlying surface. It is to be appreciated that bar 440 can be mounted in six different positions and assembled with the clamp bar 360 and adaptor blade 322 and then mounted on mold board 16. A first position comprising mounting holes 390 include face 447 facing outward and edge 443 in a downward position. A second position includes face 447 facing outward and edge 443 in a downward position while utilizing the second mounting holes 392. A third position includes face 447 facing outward and edge 443 in a downward position while utilizing mounting holes 394. A fourth position includes face 447 facing outward and edge 445 in a downward position while utilizing mounting holes 394. A fifth position includes face 447 facing outward and edge 445 in a downward position while utilizing mounting holes 392. A sixth position includes face 447 facing outward and edge 445 in a downward position while utilizing mounting holes 390. The elastomeric blade 440 can thus be rotated lengthwise to position each edge 443, 445, in three different positions, respectively, in order to enable even wear and to extend the life of elastomeric blade 440. The adaptor blade 322 can be pre-mounted to mold board 16 and the assembly of plow blade edge kit 20G to simplify the changing of position of the elastomeric blade 440 as the blade 440 is worn along the respective edges 443, 445.

The embodiment of plow blade edge kit 20G includes the use of the steel bushing 388 comprising three independent mounting holes including the respective mounting positions 390, 392, 394. Similar to the description above, the three independent mounting holes enable the elastomeric blade 440 to be selectively positioned and rotated such that each edge 443, 445 can be mounted in three different positions, respectively, in order to enable even wear and to extend the life of elastomeric blade 440. Mounting holes can be aligned along the respective bars and blades 322, 440, 360 for receiving bolts 368, 376 and for mounting to mold board 16. The elastomeric blade 440 can be temporarily held in place by mounting bushings 388 and bolts 376 which can be aligned with corresponding mounting holes in elastomeric blade 440. The mounting bushings 388 are retained inside corresponding countersunk mounting openings 389 in elastomeric blade 440 for temporary retention to elastomeric blade 440. It is to be appreciated, that during mounting, bolts 376 can be passed (in turn) through adaptor blade 322, elastomeric blade 440, and clamp bar 360. Nuts 377 can then be fastened to bolts 376 for securing components 360, 440, 322 together.

It is to be appreciated that the clamp bar 360 can be turned or flipped over which provides a quick and easy method for changing or flipping the elastomeric blade 440 from the first through the sixth position.

In one mounting position, one portion 441 of the plow segment 440 can extend below clamp bar 360 and adaptor blade 322, in another portion 442 it can extend above the clamp bar 360 and adaptor blade 322. The sandwiched elastomeric blade 440, i.e. sandwiched between clamp bar 360 and adaptor blade 322, associated with the mounting arrangement detailed in FIGS. 26-27, reduces the "skipping" of the elastomeric blade 440 as the blade assembly 20G is pushed across a surface. The alternative mounting arrangements and positions, detailed in FIGS. 26-27, reduces the "moment arm" of the elastomeric blade 440 about a mounting axis while the assembly 20G is engaged with and pushed along a surface. This reduction "moment arm" further reduces "skipping" of the elastomeric blade 440 while the edge 443 or 445 is engaged with and pushed along a surface.

It is to be appreciated that elastomeric blades 340, 440, and their respective mounting bushings 378, 388 can be used in a variety of plow blade types and arrangements. Although not shown, elastomeric blades 340, 440 can be used in conjunction with a pusher box type plow. Typically, pusher box type plows are longer than snow removal type blades. Due to the length of pusher box type plows, oftentimes they are misshapened, warped, and/or subjected to uneven wear along the bottom edge of the blade. As described above, multiple blade segments including multiple elastomeric blade sections can be mounted to a single blade. Due to the variety of multiple mounting options of bushings 378, 388, any one elastomeric plow segment can be mounted in a different mounting hole than another corresponding elastomeric plow segment. For example, one of the elastomeric plow segments can utilize mounting holes 380 while another elastomeric plow segment can make use of mounting holes 382. In this manner, each of the elastomeric plow segments can be independently adjusted for misshapened, warped, or uneven wear along a bottom edge of the blade. It is perceivable that a pusher box type plow, or similar, could incorporate 3, 4, or more elastomeric plow segments wherein each of the plow segments can utilize a respective mounting hole to provide for an improved level edge presented to the surface below. It is to be appreciated that the mounting bushing 388 provides for an even further refinement of customized mounting positions, wherein each elastomeric plow segment, from a plurality of plow segments, can utilize the respective mounting hole that provides for generally an overall level elastomeric edge presented to the surface below.

While the present disclosure has been particularly shown and described with reference to several embodiments, it will be understood by those skilled in the art that various changes in form and details may be made to the present disclosure without departing from the spirit and scope of the present disclosure described in the following claims.

The invention claimed is:

1. A plow blade edge system for mounting to an associated mold board of a plow, the system comprising:

at least one adapter blade segment including a carbide reinforced bottom edge along at least a portion of the at least one adapter blade segment for resisting wear on an associated plow blade;

at least one elastomeric blade segment;

a clamp bar providing a hardened surface; and, wherein the plow blade edge system is mountable to the associated mold board of the plow with the at least one elastomeric blade segment being securable adjacent to and supportable between the clamp bar and the at least one adapter blade segment.

2. The plow blade edge system as recited in claim 1 further comprising:

a series of holes included in the clamp bar that align with holes and bushings in the at least one elastomeric blade segment, the at least one adapter blade segment, and the associated mold board.

3. The plow blade edge system as recited in claim 1 further comprising:

mounting tabs located on distal ends of the clamp bar and being capable of being received in corresponding mounting holes in the at least one elastomeric blade to hold the clamp bar in place adjacent to the at least one elastomeric blade segment.

4. The plow blade edge system as recited in claim 1 further comprising:

a set of mechanical fasteners operative to attach the plow blade edge system to the associated mold board.

5. The plow blade edge system as recited in claim 4, wherein the mounting holes are equally-spaced along each of the at least one adapter blade segment, the at least one elastomeric blade segment, and the clamp bar.

6. The plow blade edge system as recited in claim 1 further comprising:

bolts being adapted to pass through each of the at least one adapter blade segment, the at least one elastomeric blade segment, and the clamp bar during mounting of the plow blade edge system to the associated mold board; and nuts adapted to be fastened to the bolts for securing the at least one adapter blade segment, the at least one elastomeric blade segment, and the clamp bar to the associated mold board.

7. The plow blade edge system as recited in claim 1, wherein in the mounting position the at least one elastomeric blade segment comprises a portion extending below the clamp bar for moving fluids in a path of the associated plow blade.

8. The plow blade edge system as recited in claim 1, wherein in the mounting position, the at least one elastomeric blade segment is located upstream from the at least one adapter blade segment, and the clamp bar is located upstream from the at least one elastomeric blade segment.

9. The plow blade edge system as recited in claim 1, wherein the at least one elastomeric blade segment is formed of a material selected from the group consisting of:

styrene butadiene rubber (SBR), polyurethane, polyethylene, polystyrene, and rubber.

10. The plow blade edge system as recited in claim 1 further comprising:

at least two elastomeric blade segments and at least two adapter blade segments each having a length that is a portion of a length of the associated plow body, wherein any combination of the at least two elastomeric blade segments or the at least two adapter blade segments can be combined to extend across the associated plow body.

11. A method for replacing an existing plow edge with an elastomeric plow edge, the method comprising:

providing at least one adapter blade segment including a carbide reinforced bottom edge along at least a portion of the at least one adapter blade segment, the carbide reinforced bottom edge for resisting wear on an associated plow blade;

providing at least one elastomeric blade segment;

providing a clamp bar including a hardened surface; and, providing a mounting feature on the clamp bar for mounting the clamp bar to the at least one adapter blade segment with the at least one elastomeric blade segment and for securing the at least one elastomeric blade segment between the clamp bar and the at least one adapter blade segment.

12. The method as recited in claim 11 further comprising:

providing a series of holes included in the clamp bar that align with holes and bushings in the at least one elastomeric blade segment, the at least one adapter blade segment, and the associated mold board.

13. The method as recited in claim 11 further comprising:

providing mounting tabs located on distal ends of the clamp bar, the mounting tabs being capable of being received in corresponding mounting holes in the at least one elastomeric blade to hold the clamp bar in place adjacent to the at least one elastomeric blade segment.

14. The method as recited in claim 11 further comprising:

providing a set of mechanical fasteners operative to attach the at least one elastomeric blade segment to the associated mold board in selectively a first position or at least a second position.

15. The method as recited in claim 14, wherein the mounting holes are equally-spaced along each of the at least one adapter blade segment, the at least one elastomeric blade segment, and the clamp bar.

16. The method as recited in claim 11 further comprising:

providing bolts being adapted to pass through each of the at least one adapter blade segment, the at least one elastomeric blade segment, and the clamp bar during mounting of the plow blade edge system to the associated mold board; and providing nuts adapted to be fastened to the bolts for securing the at least one adapter blade segment, the at least one elastomeric blade segment, and the clamp bar to the associated mold board.

17. The method as recited in claim 11, wherein a height of an elastomeric blade segment is greater than a height of the clamp bar such that, in the mounting position, one portion of an elastomeric blade segment extends below the clamp bar for moving fluids in a path of the associated plow blade.

18. The method as recited in claim 11, wherein in the mounting position, the at least one elastomeric blade segment is located upstream from the at least one adapter blade segment, and the clamp bar is located upstream from the at least one elastomeric blade segment.

19. The method as recited in claim 11, wherein the at least one elastomeric blade segment is formed of a material selected from the group consisting of:

styrene butadiene rubber (SBR), polyurethane, polyethylene, polystyrene, and rubber.

20. The method as recited in claim 11 further comprising:

providing at least two elastomeric blade segments and at least two adapter blade segments each having a length that is a portion of a length of an associated plow body, wherein any combination of the at least two elastomeric blade segments or the at least two adapter blade segments can be combined to extend across the associated plow body.

* * * * *